US010443863B2

(12) United States Patent
Alsaleem et al.

(10) Patent No.: US 10,443,863 B2
(45) **Date of Patent: *Oct. 15, 2019**

(54) METHOD OF MONITORING CHARGE CONDITION OF HEAT PUMP SYSTEM

(71) Applicant: Emerson Climate Technologies, Inc., Sidney, OH (US)

(72) Inventors: Fadi M. Alsaleem, Omaha, NE (US); Gregg M. Hemmelgarn, Yorkshire, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/113,271

(22) Filed: Aug. 27, 2018

(65) Prior Publication Data

US 2018/0363926 A1 Dec. 20, 2018

Related U.S. Application Data

(60) Division of application No. 14/607,782, filed on Jan. 28, 2015, now Pat. No. 10,060,636, which is a (Continued)

(51) Int. Cl.

| | |
|---|---|
| ***F24D 19/10*** | (2006.01) |
| ***F25B 49/00*** | (2006.01) |
| ***F25B 13/00*** | (2006.01) |

(52) U.S. Cl.

CPC ..... *F24D 19/1087* (2013.01); *F25B 49/00* (2013.01); *F25B 49/005* (2013.01); (Continued)

(58) Field of Classification Search

CPC ..... F25B 2500/22; F25B 2500/23; F25B 2500/24; F25B 2700/21172; F25B 2700/21173; F25B 2700/04 (Continued)

(56) References Cited

U.S. PATENT DOCUMENTS

| | | | |
|---|---|---|---|
| 2,054,542 | A | 9/1936 | Hoelle |
| 2,296,822 | A | 9/1942 | Wolfert |

(Continued)

FOREIGN PATENT DOCUMENTS

| | | | |
|---|---|---|---|
| CA | 1147440 | A1 | 5/1983 |
| CA | 1151265 | A1 | 8/1983 |

(Continued)

OTHER PUBLICATIONS

"A Practical Example of a Building's Automatic Control," cited in First Office Action from the Patent Office of the People's Republic of China dated Jun. 29, 2007, regarding Application No. 200510005907.8, including translation by CCPIT Patent and Trademark Law Office.

(Continued)

*Primary Examiner* — Paul Alvare

(74) *Attorney, Agent, or Firm* — Harness, Dickey & Pierce, P.L.C.

(57) ABSTRACT

A heat-pump circuit may include an indoor heat exchanger, an outdoor heat exchanger, a compressor adapted to circulate a working fluid between the indoor and outdoor heat exchangers, and an expansion device disposed between the indoor and outdoor heat exchangers. A monitor for the heat-pump system may include a return-air temperature sensor, a supply-air temperature sensor, and a processor. The return-air temperature sensor may be adapted to measure a first air temperature of air upstream of the indoor heat exchanger. The supply-air temperature sensor may be adapted to measure a second air temperature of air downstream of the indoor heat exchanger. The processor may be in communication with the return-air temperature sensor and the supply-air temperature sensor. The processor may be programmed to determine a working-fluid-charge condition (Continued)

of the heat-pump system based on the first and second air temperatures.

7 Claims, 2 Drawing Sheets

Related U.S. Application Data continuation of application No. 14/244,967, filed on Apr. 4, 2014, now Pat. No. 9,765,979.

(60) Provisional application No. 61/808,688, filed on Apr. 5, 2013.

(52) U.S. Cl.
CPC ..... *H05K 999/99* (2013.01); *F24D 2220/042* (2013.01); *F25B 13/00* (2013.01); *F25B 2500/22* (2013.01); *F25B 2500/23* (2013.01); *F25B 2500/24* (2013.01); *F25B 2700/2106* (2013.01); *F25B 2700/21161* (2013.01); *F25B 2700/21163* (2013.01); *F25B 2700/21172* (2013.01); *F25B 2700/21173* (2013.01)

(58) Field of Classification Search
USPC ..... 165/11.1, 288–293; 62/126, 129
See application file for complete search history.

(56) References Cited

U.S. PATENT DOCUMENTS 2,631,050 A 3/1953 Haeberlein
2,804,839 A 9/1957 Hallinan
2,961,606 A 11/1960 Mead
2,962,702 A 11/1960 Derr et al.
2,978,879 A 4/1961 Heidorn
3,027,865 A 4/1962 Kautz et al.
3,047,696 A 7/1962 Heidorn
3,082,951 A 3/1963 Kayan
3,107,843 A 10/1963 Finn
3,170,304 A 2/1965 Hale
3,232,519 A 2/1966 Long
3,278,111 A 10/1966 Parker
3,327,197 A 6/1967 Marquis
3,339,164 A 8/1967 Landis et al.
3,400,374 A 9/1968 Schumann
3,513,662 A 5/1970 Golber
3,581,281 A 5/1971 Martin et al.
3,585,451 A 6/1971 Day, III
3,653,783 A 4/1972 Sauder
3,660,718 A 5/1972 Pinckaers
3,665,339 A 5/1972 Liu
3,665,399 A 5/1972 Zehr et al.
3,680,324 A 8/1972 Garland
3,697,953 A 10/1972 Schoenwitz
3,707,851 A 1/1973 McAshan, Jr.
3,729,949 A 5/1973 Talbot
3,735,377 A 5/1973 Kaufman
3,742,302 A 6/1973 Neill
3,742,303 A 6/1973 Dageford
3,767,328 A 10/1973 Ladusaw
3,777,240 A 12/1973 Neill
3,783,681 A 1/1974 Hirt et al.
3,820,074 A 6/1974 Toman
3,882,305 A 5/1975 Johnstone
3,924,972 A 12/1975 Szymaszek
3,927,712 A 12/1975 Nakayama
3,935,519 A 1/1976 Pfarrer et al.
3,950,962 A 4/1976 Odashima
3,960,011 A 6/1976 Renz et al.
3,978,382 A 8/1976 Pfarrer et al.
3,998,068 A 12/1976 Chirnside
4,006,460 A 2/1977 Hewitt et al.
4,014,182 A 3/1977 Granryd
4,018,584 A 4/1977 Mullen
4,019,172 A 4/1977 Srodes
4,024,725 A 5/1977 Uchida et al.
4,027,289 A 5/1977 Toman
4,034,570 A 7/1977 Anderson et al.
4,038,061 A 7/1977 Anderson et al.
4,045,973 A 9/1977 Anderson et al.
4,046,532 A 9/1977 Nelson
RE29,450 E 10/1977 Goldsby et al.
4,060,716 A 11/1977 Pekrul et al.
4,066,869 A 1/1978 Apaloo et al.
4,090,248 A 5/1978 Swanson et al.
4,102,150 A 7/1978 Kountz
4,102,394 A 7/1978 Botts
4,104,888 A 8/1978 Reedy et al.
4,105,063 A 8/1978 Bergt
4,112,703 A 9/1978 Kountz
4,132,086 A 1/1979 Kountz
4,136,730 A 1/1979 Kinsey
4,137,057 A 1/1979 Piet et al.
4,137,725 A 2/1979 Martin
4,142,375 A 3/1979 Abe et al.
4,143,707 A 3/1979 Lewis et al.
4,146,085 A 3/1979 Wills
RE29,966 E 4/1979 Nussbaum
4,151,725 A 5/1979 Kountz et al.
4,153,003 A 5/1979 Willis
4,156,350 A 5/1979 Elliott et al.
4,161,106 A 7/1979 Savage et al.
4,165,619 A 8/1979 Girard
4,171,622 A 10/1979 Yamaguchi et al.
4,173,871 A 11/1979 Brooks
4,178,988 A 12/1979 Cann et al.
RE30,242 E 4/1980 del Toro et al.
4,197,717 A 4/1980 Schumacher
4,205,381 A 5/1980 Games et al.
4,209,994 A 7/1980 Mueller et al.
4,211,089 A 7/1980 Mueller et al.
4,217,761 A 8/1980 Cornaire et al.
4,220,010 A 9/1980 Mueller et al.
4,227,862 A 10/1980 Andrew et al.
4,232,530 A 11/1980 Mueller
4,233,818 A 11/1980 Lastinger
4,236,379 A 12/1980 Mueller
4,244,182 A 1/1981 Behr
4,246,763 A 1/1981 Mueller et al.
4,248,051 A 2/1981 Darcy et al.
4,251,988 A 2/1981 Allard et al.
4,257,795 A 3/1981 Shaw
4,259,847 A 4/1981 Pearse, Jr.
4,267,702 A 5/1981 Houk
4,270,174 A 5/1981 Karlin et al.
4,271,898 A 6/1981 Freeman
4,281,358 A 7/1981 Plouffe et al.
4,284,849 A 8/1981 Anderson et al.
4,286,438 A 9/1981 Clarke
4,290,480 A 9/1981 Sulkowski
4,296,727 A 10/1981 Bryan
4,301,660 A 11/1981 Mueller et al.
4,306,293 A 12/1981 Marathe
4,307,775 A 12/1981 Saunders et al.
4,308,725 A 1/1982 Chiyoda
4,311,188 A 1/1982 Kojima et al.
4,319,461 A 3/1982 Shaw
4,321,529 A 3/1982 Simmonds et al.
4,325,223 A 4/1982 Cantley
4,328,678 A 5/1982 Kono et al.
4,328,680 A 5/1982 Stamp, Jr. et al.
4,333,316 A 6/1982 Stamp, Jr. et al.
4,333,317 A 6/1982 Sawyer
4,336,001 A 6/1982 Andrew et al.
4,338,790 A 7/1982 Saunders et al.
4,338,791 A 7/1982 Stamp, Jr. et al.
4,345,162 A 8/1982 Hammer et al.
4,346,755 A 8/1982 Alley et al.
4,350,021 A 9/1982 Lundstrom
4,350,023 A 9/1982 Kuwabara et al.
4,351,163 A 9/1982 Johannsen
4,356,703 A 11/1982 Vogel

(56) References Cited

U.S. PATENT DOCUMENTS 4,361,273 A 11/1982 Levine et al.
4,365,983 A 12/1982 Abraham et al.
4,370,098 A 1/1983 McClain et al.
4,372,119 A 2/1983 Gillbrand et al.
4,376,926 A 3/1983 Senor
4,381,549 A 4/1983 Stamp, Jr. et al.
4,382,367 A 5/1983 Roberts
4,384,462 A 5/1983 Overman et al.
4,387,368 A 6/1983 Day, III et al.
4,387,578 A 6/1983 Paddock
4,390,058 A 6/1983 Otake et al.
4,390,321 A 6/1983 Langlois et al.
4,390,922 A 6/1983 Pelliccia
4,395,886 A 8/1983 Mayer
4,395,887 A 8/1983 Sweetman
4,399,548 A 8/1983 Castleberry
4,402,054 A 8/1983 Osborne et al.
4,406,133 A 9/1983 Saunders et al.
4,407,138 A 10/1983 Mueller
4,408,660 A 10/1983 Sutoh et al.
4,412,788 A 11/1983 Shaw et al.
4,415,896 A 11/1983 Allgood
4,418,388 A 11/1983 Allgor et al.
4,420,947 A 12/1983 Yoshino
4,425,010 A 1/1984 Bryant et al.
4,429,578 A 2/1984 Darrel et al.
4,432,232 A 2/1984 Brantley et al.
4,434,390 A 2/1984 Elms
4,441,329 A 4/1984 Dawley
4,448,038 A 5/1984 Barbier
4,449,375 A 5/1984 Briccetti
4,451,929 A 5/1984 Yoshida
4,460,123 A 7/1984 Beverly
4,463,571 A 8/1984 Wiggs
4,463,574 A 8/1984 Spethmann et al.
4,463,576 A 8/1984 Burnett et al.
4,465,229 A 8/1984 Kompelien
4,467,230 A 8/1984 Rovinsky
4,467,385 A 8/1984 Bandoli et al.
4,467,613 A 8/1984 Behr et al.
4,470,092 A 9/1984 Lombardi
4,470,266 A 9/1984 Briccetti et al.
4,474,024 A 10/1984 Eplett et al.
4,474,542 A 10/1984 Kato et al.
4,479,389 A 10/1984 Anderson, III et al.
4,484,452 A * 11/1984 Houser, Jr. ..... F25B 13/00
62/149
4,489,551 A 12/1984 Watanabe et al.
4,490,986 A 1/1985 Paddock
4,494,383 A 1/1985 Nagatomo et al.
4,495,779 A 1/1985 Tanaka et al.
4,496,296 A 1/1985 Arai et al.
4,497,031 A 1/1985 Froehling et al.
4,498,310 A 2/1985 Lmanishi et al.
4,499,739 A 2/1985 Matsuoka et al.
4,502,084 A 2/1985 Hannett
4,502,833 A 3/1985 Hibino et al.
4,502,842 A 3/1985 Currier et al.
4,502,843 A 3/1985 Martin
4,505,125 A 3/1985 Baglione
4,506,518 A 3/1985 Yoshikawa et al.
4,507,934 A 4/1985 Tanaka et al.
4,510,547 A 4/1985 Rudich, Jr.
4,510,576 A 4/1985 MacArthur et al.
4,512,161 A 4/1985 Logan et al.
4,516,407 A 5/1985 Watabe
4,517,468 A 5/1985 Kemper et al.
4,520,674 A 6/1985 Canada et al.
4,523,435 A 6/1985 Lord
4,523,436 A 6/1985 Schedel et al.
4,527,247 A 7/1985 Kaiser et al.
4,527,399 A 7/1985 Lord
4,535,607 A 8/1985 Mount
4,538,420 A 9/1985 Nelson
4,538,422 A 9/1985 Mount et al.
4,539,820 A 9/1985 Zinsmeyer
4,540,040 A 9/1985 Fukumoto et al.
4,545,210 A 10/1985 Lord
4,545,214 A 10/1985 Kinoshita
4,548,549 A 10/1985 Murphy et al.
4,549,403 A 10/1985 Lord et al.
4,549,404 A 10/1985 Lord
4,550,770 A 11/1985 Nussdorfer et al.
4,553,400 A 11/1985 Branz
4,555,057 A 11/1985 Foster
4,555,910 A 12/1985 Sturges
4,557,317 A 12/1985 Harmon, Jr.
4,558,181 A 12/1985 Blanchard et al.
4,561,260 A 12/1985 Nishi et al.
4,563,624 A 1/1986 Yu
4,563,877 A 1/1986 Harnish
4,563,878 A 1/1986 Baglione
4,567,733 A 2/1986 Mecozzi
4,568,909 A 2/1986 Whynacht
4,574,871 A 3/1986 Parkinson et al.
4,575,318 A 3/1986 Blain
4,577,977 A 3/1986 Pejsa
4,580,947 A 4/1986 Shibata et al.
4,583,373 A 4/1986 Shaw
4,589,060 A 5/1986 Zinsmeyer
4,593,367 A 6/1986 Slack et al.
4,598,764 A 7/1986 Beckey
4,602,484 A 7/1986 Bendikson
4,603,556 A 8/1986 Suefuji et al.
4,604,036 A 8/1986 Sutou et al.
4,611,470 A 9/1986 Enstrom
4,612,775 A 9/1986 Branz et al.
4,614,089 A 9/1986 Dorsey
4,617,804 A 10/1986 Fukushima et al.
4,620,286 A 10/1986 Smith et al.
4,620,424 A 11/1986 Tanaka et al.
4,621,502 A 11/1986 Ibrahim et al.
4,626,753 A 12/1986 Letterman
4,627,245 A 12/1986 Levine
4,627,483 A 12/1986 Harshbarger, III et al.
4,627,484 A 12/1986 Harshbarger, Jr. et al.
4,630,572 A 12/1986 Evans
4,630,670 A 12/1986 Wellman et al.
4,642,034 A 2/1987 Terauchi
4,642,782 A 2/1987 Kemper et al.
4,644,479 A 2/1987 Kemper et al.
4,646,532 A 3/1987 Nose
4,648,044 A 3/1987 Hardy et al.
4,649,515 A 3/1987 Thompson et al.
4,649,710 A 3/1987 Inoue et al.
4,653,280 A 3/1987 Hansen et al.
4,653,285 A 3/1987 Pohl
4,655,688 A 4/1987 Bohn et al.
4,660,386 A 4/1987 Hansen et al.
4,662,184 A 5/1987 Pohl et al.
4,674,292 A 6/1987 Ohya et al.
4,677,830 A 7/1987 Sumikawa et al.
4,680,940 A 7/1987 Vaughn
4,682,473 A 7/1987 Rogers, III
4,684,060 A 8/1987 Adams et al.
4,685,615 A 8/1987 Hart
4,686,835 A 8/1987 Alsenz
4,689,967 A 9/1987 Han et al.
4,697,431 A 10/1987 Alsenz
4,698,978 A 10/1987 Jones
4,698,981 A 10/1987 Kaneko et al.
4,701,824 A 10/1987 Beggs et al.
4,703,325 A 10/1987 Chamberlin et al.
4,706,152 A 11/1987 DeFilippis et al.
4,706,469 A 11/1987 Oguni et al.
4,712,648 A 12/1987 Mattes et al.
4,713,717 A 12/1987 Pejouhy et al.
4,715,190 A 12/1987 Han et al.
4,715,792 A 12/1987 Nishizawa et al.
4,716,582 A 12/1987 Blanchard et al.
4,716,957 A 1/1988 Thompson et al.
4,720,980 A 1/1988 Howland
4,722,018 A 1/1988 Pohl
4,722,019 A 1/1988 Pohl

(56) References Cited

U.S. PATENT DOCUMENTS 4,724,678 A 2/1988 Pohl
4,735,054 A 4/1988 Beckey
4,735,060 A 4/1988 Alsenz
4,744,223 A 5/1988 Umezu
4,745,765 A 5/1988 Pettitt
4,745,766 A 5/1988 Bahr
4,745,767 A 5/1988 Ohya et al.
4,750,332 A 6/1988 Jenski et al.
4,750,672 A 6/1988 Beckey et al.
4,751,501 A 6/1988 Gut
4,751,825 A 6/1988 Voorhis et al.
4,754,410 A 6/1988 Leech et al.
4,755,957 A 7/1988 White et al.
4,765,150 A 8/1988 Persem
4,768,346 A 9/1988 Mathur
4,768,348 A 9/1988 Noguchi
4,783,752 A 11/1988 Kaplan et al.
4,787,213 A 11/1988 Gras et al.
4,790,142 A 12/1988 Beckey
4,796,142 A 1/1989 Libert
4,796,466 A 1/1989 Farmer
4,798,055 A 1/1989 Murray et al.
4,805,118 A 2/1989 Rishel
4,807,445 A 2/1989 Matsuoka et al.
4,820,130 A 4/1989 Eber et al.
4,829,779 A 5/1989 Munson et al.
4,831,560 A 5/1989 Zaleski
4,831,832 A 5/1989 Alsenz
4,831,833 A 5/1989 Duenes et al.
4,835,706 A 5/1989 Asahi
4,835,980 A 6/1989 Oyanagi et al.
4,838,037 A 6/1989 Wood
4,841,734 A 6/1989 Torrence
4,843,575 A 6/1989 Crane
4,845,956 A 7/1989 Berntsen et al.
4,848,099 A 7/1989 Beckey et al.
4,848,100 A 7/1989 Barthel et al.
4,850,198 A 7/1989 Helt et al.
4,850,204 A 7/1989 Bos et al.
4,852,363 A 8/1989 Kampf et al.
4,853,693 A 8/1989 Eaton-Williams
4,856,286 A 8/1989 Sulfstede et al.
4,858,676 A 8/1989 Bolfik et al.
4,866,635 A 9/1989 Kahn et al.
4,866,944 A 9/1989 Yamazaki
4,869,073 A 9/1989 Kawai et al.
4,873,836 A 10/1989 Thompson
4,875,589 A 10/1989 Lacey et al.
4,877,382 A 10/1989 Caillat et al.
4,878,355 A 11/1989 Beckey et al.
4,881,184 A 11/1989 Abegg, III et al.
4,882,747 A 11/1989 Williams
4,882,908 A 11/1989 White
4,884,412 A 12/1989 Sellers et al.
4,885,707 A 12/1989 Nichol et al.
4,885,914 A 12/1989 Pearman
4,887,436 A 12/1989 Enomoto et al.
4,887,857 A 12/1989 VanOmmeren
4,889,280 A 12/1989 Grald et al.
4,893,480 A 1/1990 Matsui et al.
4,899,551 A 2/1990 Weintraub
4,903,500 A 2/1990 Hanson
4,903,759 A 2/1990 Lapeyrouse
4,904,993 A 2/1990 Sato
4,909,041 A 3/1990 Jones
4,909,076 A 3/1990 Busch et al.
4,910,966 A 3/1990 Levine et al.
4,913,625 A 4/1990 Gerlowski
4,916,633 A 4/1990 Tychonievich et al.
4,916,909 A 4/1990 Mathur et al.
4,916,912 A 4/1990 Levine et al.
4,918,690 A 4/1990 Markkula, Jr. et al.
4,918,932 A 4/1990 Gustafson et al.
4,924,404 A 5/1990 Reinke, Jr.
4,924,418 A 5/1990 Bachman et al.
4,928,750 A 5/1990 Nurczyk
4,932,588 A 6/1990 Fedter et al.
4,939,909 A 7/1990 Tsuchiyama et al.
4,943,003 A 7/1990 Shimizu et al.
4,944,160 A 7/1990 Malone et al.
4,945,491 A 7/1990 Rishel
4,948,040 A 8/1990 Kobayashi et al.
4,949,550 A 8/1990 Hanson
4,953,784 A 9/1990 Yasufuku et al.
4,959,970 A 10/1990 Meckler
4,964,060 A 10/1990 Hartsog
4,964,125 A 10/1990 Kim
4,966,006 A 10/1990 Thuesen et al.
4,967,567 A 11/1990 Proctor et al.
4,970,496 A 11/1990 Kirkpatrick
4,974,427 A 12/1990 Diab
4,974,665 A 12/1990 Zillner, Jr.
4,975,024 A 12/1990 Heckel
4,977,751 A 12/1990 Hanson
4,985,857 A 1/1991 Bajpai et al.
4,987,748 A 1/1991 Meckler
4,990,057 A 2/1991 Rollins
4,990,893 A 2/1991 Kiluk
4,991,770 A 2/1991 Bird et al.
5,000,009 A 3/1991 Clanin
5,005,365 A 4/1991 Lynch
5,009,074 A 4/1991 Goubeaux et al.
5,009,075 A 4/1991 Okoren
5,009,076 A 4/1991 Winslow
5,012,629 A 5/1991 Rehman et al.
5,018,357 A 5/1991 Livingstone et al.
5,018,665 A 5/1991 Sulmone
RE33,620 E 6/1991 Persem
5,022,234 A 6/1991 Goubeaux et al.
5,039,009 A 8/1991 Baldwin et al.
5,042,264 A 8/1991 Dudley
5,051,720 A 9/1991 Kittirutsunetorn
5,054,294 A 10/1991 Dudley
5,056,036 A 10/1991 Van Bork
5,056,329 A 10/1991 Wilkinson
5,058,388 A 10/1991 Shaw et al.
5,062,278 A 11/1991 Sugiyama
5,065,593 A 11/1991 Dudley et al.
5,067,099 A 11/1991 McCown et al.
RE33,775 E 12/1991 Behr et al.
5,070,468 A 12/1991 Niinomi et al.
5,071,065 A 12/1991 Aalto et al.
5,073,091 A 12/1991 Burgess et al.
5,073,862 A 12/1991 Carlson
5,076,067 A 12/1991 Prenger et al.
5,076,494 A 12/1991 Ripka
5,077,983 A 1/1992 Dudley
5,083,438 A 1/1992 McMullin
5,086,385 A 2/1992 Launey et al.
5,088,297 A 2/1992 Maruyama et al.
5,094,086 A 3/1992 Shyu
5,095,712 A 3/1992 Narreau
5,095,715 A 3/1992 Dudley
5,099,654 A 3/1992 Baruschke et al.
5,102,316 A 4/1992 Caillat et al.
5,103,391 A 4/1992 Barrett
5,107,500 A 4/1992 Wakamoto et al.
5,109,222 A 4/1992 Welty
5,109,676 A 5/1992 Waters et al.
5,109,700 A 5/1992 Hicho
5,109,916 A 5/1992 Thompson
5,115,406 A 5/1992 Zatezalo et al.
5,115,643 A 5/1992 Hayata et al.
5,115,644 A 5/1992 Alsenz
5,115,967 A 5/1992 Wedekind
5,118,260 A 6/1992 Fraser, Jr.
5,119,466 A 6/1992 Suzuki
5,119,637 A 6/1992 Bard et al.
5,121,610 A 6/1992 Atkinson et al.
5,123,017 A 6/1992 Simpkins et al.
5,123,252 A 6/1992 Hanson
5,123,253 A 6/1992 Hanson et al.
5,123,255 A 6/1992 Ohizumi
5,125,067 A 6/1992 Erdman

(56) References Cited

U.S. PATENT DOCUMENTS

RE34,001 E 7/1992 Wrobel
5,127,232 A 7/1992 Paige et al.
5,131,237 A 7/1992 Valbjorn
5,136,855 A 8/1992 Lenarduzzi
5,140,394 A 8/1992 Cobb, III et al.
5,141,407 A 8/1992 Ramsey et al.
5,142,877 A 9/1992 Shimizu
5,150,584 A 9/1992 Tomasov et al.
5,156,539 A 10/1992 Anderson et al.
5,167,494 A 12/1992 Inagaki et al.
5,170,935 A 12/1992 Federspiel et al.
5,170,936 A 12/1992 Kubo et al.
5,181,389 A 1/1993 Hanson et al.
5,186,014 A 2/1993 Runk
5,197,666 A 3/1993 Wedekind
5,199,855 A 4/1993 Nakajima et al.
5,200,872 A 4/1993 D'Entremont et al.
5,200,987 A 4/1993 Gray
5,201,862 A 4/1993 Pettitt
5,203,178 A 4/1993 Shyu
5,203,179 A 4/1993 Powell
5,209,076 A 5/1993 Kauffman et al.
5,209,400 A 5/1993 Winslow et al.
5,219,041 A 6/1993 Greve
5,224,354 A 7/1993 Ito et al.
5,224,835 A 7/1993 Oltman
5,226,472 A 7/1993 Benevelli et al.
5,228,300 A 7/1993 Shim
5,228,304 A 7/1993 Ryan
5,228,307 A 7/1993 Koce
5,230,223 A 7/1993 Hullar et al.
5,231,844 A 8/1993 Park
5,233,841 A 8/1993 Jyrek
5,235,526 A 8/1993 Saffell
5,237,830 A 8/1993 Grant
5,241,664 A 8/1993 Ohba et al.
5,241,833 A 9/1993 Ohkoshi
5,243,827 A 9/1993 Hagita et al.
5,243,829 A 9/1993 Bessler
5,245,833 A 9/1993 Mei et al.
5,248,244 A 9/1993 Ho et al.
5,251,453 A 10/1993 Stanke et al.
5,251,454 A 10/1993 Yoon
5,255,977 A 10/1993 Eimer et al.
5,257,506 A 11/1993 DeWolf et al.
5,262,704 A 11/1993 Farr
5,265,434 A 11/1993 Alsenz
5,269,458 A 12/1993 Sol
5,271,556 A 12/1993 Helt et al.
5,274,571 A 12/1993 Hesse et al.
5,276,630 A 1/1994 Baldwin et al.
5,279,458 A 1/1994 DeWolf et al.
5,282,728 A 2/1994 Swain
5,284,026 A 2/1994 Powell
5,285,646 A 2/1994 TaeDuk
5,289,362 A 2/1994 Liebl et al.
5,290,154 A 3/1994 Kotlarek et al.
5,291,752 A 3/1994 Alvarez et al.
5,299,504 A 4/1994 Abele
5,303,112 A 4/1994 Zulaski et al.
5,303,560 A 4/1994 Hanson et al.
5,311,451 A 5/1994 Barrett
5,311,562 A 5/1994 Palusamy et al.
5,316,448 A 5/1994 Ziegler et al.
5,320,506 A 6/1994 Fogt
5,333,460 A 8/1994 Lewis et al.
5,335,507 A 8/1994 Powell
5,336,058 A 8/1994 Yokoyama
5,337,576 A 8/1994 Dorfman et al.
5,347,476 A 9/1994 McBean, Sr.
5,351,037 A 9/1994 Martell et al.
5,362,206 A 11/1994 Westerman et al.
5,362,211 A 11/1994 Iizuka et al.
5,368,446 A 11/1994 Rode
5,369,958 A 12/1994 Kasai et al.
5,381,669 A 1/1995 Bahel et al.
5,381,692 A 1/1995 Winslow et al.
5,388,176 A 2/1995 Dykstra et al.
5,395,042 A 3/1995 Riley et al.
5,410,230 A 4/1995 Bessler et al.
5,414,792 A 5/1995 Shorey
5,415,008 A 5/1995 Bessler
5,416,781 A 5/1995 Ruiz
5,423,190 A 6/1995 Friedland
5,423,192 A 6/1995 Young et al.
5,426,952 A 6/1995 Bessler
5,431,026 A 7/1995 Jaster
5,432,500 A 7/1995 Scripps
5,435,145 A 7/1995 Jaster
5,435,148 A 7/1995 Sandofsky et al.
5,440,890 A 8/1995 Bahel et al.
5,440,891 A 8/1995 Hindmon, Jr. et al.
5,440,895 A 8/1995 Bahel et al.
5,446,677 A 8/1995 Jensen et al.
5,450,359 A 9/1995 Sharma et al.
5,452,291 A 9/1995 Eisenhandler et al.
5,454,229 A 10/1995 Hanson et al.
5,457,965 A 10/1995 Blair et al.
5,460,006 A 10/1995 Torimitsu
5,467,011 A 11/1995 Hunt
5,467,264 A 11/1995 Rauch et al.
5,469,045 A 11/1995 Dove et al.
5,475,986 A 12/1995 Bahel et al.
5,478,212 A 12/1995 Sakai et al.
5,481,481 A 1/1996 Frey et al.
5,481,884 A 1/1996 Scoccia
5,483,141 A 1/1996 Uesugi
5,491,978 A 2/1996 Young et al.
5,495,722 A 3/1996 Manson et al.
5,499,512 A 3/1996 Jurewicz et al.
5,509,786 A 4/1996 Mizutani et al.
5,511,387 A 4/1996 Tinsler
5,512,883 A 4/1996 Lane, Jr.
5,515,267 A 5/1996 Alsenz
5,515,692 A 5/1996 Sterber et al.
5,519,301 A 5/1996 Yoshida et al.
5,519,337 A 5/1996 Casada
5,528,908 A 6/1996 Bahel et al.
5,532,534 A 7/1996 Baker et al.
5,533,347 A 7/1996 Ott et al.
5,535,136 A 7/1996 Standifer
5,535,597 A 7/1996 An
5,546,015 A 8/1996 Okabe
5,546,073 A 8/1996 Duff et al.
5,546,756 A 8/1996 Ali
5,546,757 A 8/1996 Whipple, III
5,548,966 A 8/1996 Tinsler
5,555,195 A 9/1996 Jensen et al.
5,562,426 A 10/1996 Watanabe et al.
5,563,490 A 10/1996 Kawaguchi et al.
5,564,280 A 10/1996 Schilling et al.
5,566,084 A 10/1996 Cmar
5,570,085 A 10/1996 Bertsch
5,570,258 A 10/1996 Manning
5,572,643 A 11/1996 Judson
5,577,905 A 11/1996 Momber et al.
5,579,648 A 12/1996 Hanson et al.
5,581,229 A 12/1996 Hunt
5,586,445 A 12/1996 Bessler
5,586,446 A 12/1996 Torimitsu
5,590,830 A 1/1997 Kettler et al.
5,592,058 A 1/1997 Archer et al.
5,592,824 A 1/1997 Sogabe et al.
5,596,507 A 1/1997 Jones et al.
5,600,960 A 2/1997 Schwedler et al.
5,602,749 A 2/1997 Vosburgh
5,602,757 A 2/1997 Haseley et al.
5,602,761 A 2/1997 Spoerre et al.
5,610,339 A 3/1997 Haseley et al.
5,611,674 A 3/1997 Bass et al.
5,613,841 A 3/1997 Bass et al.
5,615,071 A 3/1997 Higashikata et al.
5,616,829 A 4/1997 Balaschak et al.
5,623,834 A 4/1997 Bahel et al.

(56) References Cited

U.S. PATENT DOCUMENTS 5,628,201 A 5/1997 Bahel et al.
5,630,325 A 5/1997 Bahel et al.
5,635,896 A 6/1997 Tinsley et al.
5,641,270 A 6/1997 Sgourakes et al.
5,643,482 A 7/1997 Sandelman et al.
5,650,936 A 7/1997 Loucks et al.
5,651,263 A * 7/1997 Nonaka ..... F25B 9/006 62/205
5,655,379 A 8/1997 Jaster et al.
5,655,380 A 8/1997 Calton
5,656,765 A 8/1997 Gray
5,656,767 A 8/1997 Garvey, III et al.
5,666,815 A 9/1997 Aloise
5,682,949 A 11/1997 Ratcliffe et al.
5,684,463 A 11/1997 Diercks et al.
5,689,963 A 11/1997 Bahel et al.
5,691,692 A 11/1997 Herbstritt
5,694,010 A 12/1997 Oomura et al.
5,696,501 A 12/1997 Ouellette et al.
5,699,670 A 12/1997 Jurewicz et al.
5,706,007 A 1/1998 Fragnito et al.
5,707,210 A 1/1998 Ramsey et al.
5,711,785 A 1/1998 Maxwell
5,713,724 A 2/1998 Centers et al.
5,714,931 A 2/1998 Petite et al.
5,715,704 A 2/1998 Cholkeri et al.
5,718,822 A 2/1998 Richter
5,724,571 A 3/1998 Woods
5,729,474 A 3/1998 Hildebrand et al.
5,737,931 A 4/1998 Ueno et al.
5,741,120 A 4/1998 Bass et al.
5,743,109 A 4/1998 Schulak
5,745,114 A 4/1998 King et al.
5,749,238 A 5/1998 Schmidt
5,751,916 A 5/1998 Kon et al.
5,752,385 A 5/1998 Nelson
5,754,450 A 5/1998 Solomon et al.
5,754,732 A 5/1998 Vlahu
5,757,664 A 5/1998 Rogers et al.
5,757,892 A 5/1998 Blanchard et al.
5,761,083 A 6/1998 Brown, Jr. et al.
5,764,509 A 6/1998 Gross et al.
5,772,214 A 6/1998 Stark
5,772,403 A 6/1998 Allison et al.
5,782,101 A 7/1998 Dennis
5,784,232 A 7/1998 Farr
5,790,898 A 8/1998 Kishima et al.
5,795,381 A 8/1998 Holder
5,798,941 A 8/1998 McLeister
5,802,860 A 9/1998 Barrows
5,805,856 A 9/1998 Hanson
5,807,336 A 9/1998 Russo et al.
5,808,441 A 9/1998 Nehring
5,810,908 A 9/1998 Gray et al.
5,812,061 A 9/1998 Simons
5,825,597 A 10/1998 Young
5,827,963 A 10/1998 Selegatto et al.
5,839,094 A 11/1998 French
5,839,291 A 11/1998 Chang et al.
5,841,654 A 11/1998 Verissimo et al.
5,857,348 A 1/1999 Conry
5,860,286 A 1/1999 Tulpule
5,861,807 A 1/1999 Leyden et al.
5,867,998 A 2/1999 Guertin
5,869,960 A 2/1999 Brand
5,873,257 A 2/1999 Peterson
5,875,430 A 2/1999 Koether
5,875,638 A 3/1999 Tinsler
5,884,494 A 3/1999 Okoren et al.
5,887,786 A 3/1999 Sandelman
5,900,801 A 5/1999 Heagle et al.
5,904,049 A 5/1999 Jaster et al.
5,918,200 A 6/1999 Tsutsui et al.
5,924,295 A 7/1999 Park
5,924,486 A 7/1999 Ehlers et al.
5,926,103 A 7/1999 Petite
5,926,531 A 7/1999 Petite
5,930,773 A 7/1999 Crooks et al.
5,934,087 A 8/1999 Watanabe et al.
5,939,974 A 8/1999 Heagle et al.
5,946,922 A 9/1999 Viard et al.
5,947,693 A 9/1999 Yang
5,947,701 A 9/1999 Hugenroth
5,949,677 A 9/1999 Ho
5,950,443 A 9/1999 Meyer et al.
5,953,490 A 9/1999 Wiklund et al.
5,956,658 A 9/1999 McMahon
5,971,712 A 10/1999 Kann
5,975,854 A 11/1999 Culp, III et al.
5,984,645 A 11/1999 Cummings
5,986,571 A 11/1999 Flick
5,987,903 A 11/1999 Bathla
5,988,986 A 11/1999 Brinken et al.
5,995,347 A 11/1999 Rudd et al.
5,995,351 A 11/1999 Katsumata et al.
6,006,142 A 12/1999 Seem et al.
6,006,171 A 12/1999 Vines et al.
6,011,368 A 1/2000 Kalpathi et al.
6,013,108 A 1/2000 Karolys et al.
6,017,192 A 1/2000 Clack et al.
6,020,702 A 2/2000 Farr
6,023,420 A 2/2000 McCormick et al.
6,026,651 A 2/2000 Sandelman
6,028,522 A 2/2000 Petite
6,035,653 A 3/2000 Itoh et al.
6,035,661 A 3/2000 Sunaga et al.
6,038,871 A 3/2000 Gutierrez et al.
6,041,605 A 3/2000 Heinrichs
6,041,609 A 3/2000 Hornsleth et al.
6,041,856 A 3/2000 Thrasher et al.
6,042,344 A 3/2000 Lifson
6,044,062 A 3/2000 Brownrigg et al.
6,047,557 A 4/2000 Pham et al.
6,050,098 A 4/2000 Meyer et al.
6,050,780 A 4/2000 Hasegawa et al.
6,052,731 A 4/2000 Holdsworth et al.
6,057,771 A 5/2000 Lakra
6,065,946 A 5/2000 Lathrop
6,068,447 A 5/2000 Foege
6,070,110 A 5/2000 Shah et al.
6,075,530 A 6/2000 Lucas et al.
6,077,051 A 6/2000 Centers et al.
6,081,750 A 6/2000 Hoffberg et al.
6,082,495 A 7/2000 Steinbarger et al.
6,082,971 A 7/2000 Gunn et al.
6,085,530 A 7/2000 Barito
6,088,659 A 7/2000 Kelley et al.
6,088,688 A 7/2000 Crooks et al.
6,092,370 A 7/2000 Tremoulet, Jr. et al.
6,092,378 A 7/2000 Das et al.
6,092,992 A 7/2000 Imblum et al.
6,095,674 A 8/2000 Verissimo et al.
6,098,893 A 8/2000 Berglund et al.
6,102,665 A 8/2000 Centers et al.
6,110,260 A 8/2000 Kubokawa
6,119,949 A 9/2000 Lindstrom
6,122,603 A 9/2000 Budike, Jr.
6,125,642 A 10/2000 Seener et al.
6,128,583 A 10/2000 Dowling
6,128,953 A 10/2000 Mizukoshi
6,129,527 A 10/2000 Donahoe et al.
6,138,461 A 10/2000 Park et al.
6,142,741 A 11/2000 Nishihata et al.
6,144,888 A 11/2000 Lucas et al.
6,145,328 A 11/2000 Choi
6,147,601 A 11/2000 Sandelman et al.
6,152,375 A 11/2000 Robison
6,152,376 A 11/2000 Sandelman et al.
6,153,942 A 11/2000 Roseman et al.
6,153,993 A 11/2000 Oomura et al.
6,154,488 A 11/2000 Hunt
6,157,310 A 12/2000 Milne et al.
6,158,230 A 12/2000 Katsuki
6,160,477 A 12/2000 Sandelman et al.

(56) References Cited

U.S. PATENT DOCUMENTS 6,169,979 B1 1/2001 Johnson
6,172,476 B1 1/2001 Tolbert, Jr. et al.
6,174,136 B1 1/2001 Kilayko et al.
6,176,683 B1 1/2001 Yang
6,176,686 B1 1/2001 Wallis et al.
6,177,884 B1 1/2001 Hunt et al.
6,178,362 B1 1/2001 Woolard et al.
6,179,214 B1 1/2001 Key et al.
6,181,033 B1 1/2001 Wright
6,190,442 B1 2/2001 Redner
6,191,545 B1 2/2001 Kawabata et al.
6,192,282 B1 2/2001 Smith et al.
6,199,018 B1 3/2001 Quist et al.
6,211,782 B1 4/2001 Sandelman et al.
6,213,731 B1 4/2001 Doepker et al.
6,215,405 B1 4/2001 Handley et al.
6,216,956 B1 4/2001 Ehlers et al.
6,218,953 B1 4/2001 Petite
6,223,543 B1 5/2001 Sandelman
6,223,544 B1 5/2001 Seem
6,228,155 B1 5/2001 Tai
6,230,501 B1 5/2001 Bailey, Sr. et al.
6,233,327 B1 5/2001 Petite
6,234,019 B1 5/2001 Caldeira
6,240,733 B1 6/2001 Brandon et al.
6,240,736 B1 6/2001 Fujita et al.
6,244,061 B1 6/2001 Takagi et al.
6,249,516 B1 6/2001 Brownrigg et al.
6,260,004 B1 7/2001 Hays et al.
6,266,968 B1 7/2001 Redlich
6,268,664 B1 7/2001 Rolls et al.
6,272,868 B1 8/2001 Grabon et al.
6,276,901 B1 8/2001 Farr et al.
6,279,332 B1 8/2001 Yeo et al.
6,290,043 B1 9/2001 Ginder et al.
6,293,114 B1 9/2001 Kamemoto
6,293,767 B1 9/2001 Bass
6,302,654 B1 10/2001 Millet et al.
6,304,934 B1 10/2001 Pimenta et al.
6,320,275 B1 11/2001 Okamoto et al.
6,324,854 B1 12/2001 Jayanth
6,327,541 B1 12/2001 Pitchford et al.
6,332,327 B1 12/2001 Street et al.
6,334,093 B1 12/2001 More
6,349,883 B1 2/2002 Simmons et al.
6,350,111 B1 2/2002 Perevozchikov et al.
6,359,410 B1 3/2002 Randolph
6,360,551 B1 3/2002 Renders
6,366,889 B1 4/2002 Zaloom
6,368,065 B1 4/2002 Hugenroth et al.
6,375,439 B1 4/2002 Missio
6,378,315 B1 4/2002 Gelber et al.
6,381,971 B2 5/2002 Honda
6,385,510 B1 5/2002 Hoog et al.
6,389,823 B1 5/2002 Loprete et al.
6,390,779 B1 5/2002 Cunkelman
6,391,102 B1 5/2002 Bodden et al.
6,393,848 B2 5/2002 Roh et al.
6,397,606 B1 6/2002 Roh et al.
6,397,612 B1 6/2002 Kernkamp et al.
6,406,265 B1 6/2002 Hahn et al.
6,406,266 B1 6/2002 Hugenroth et al.
6,408,228 B1 6/2002 Seem et al.
6,408,258 B1 6/2002 Richer
6,412,293 B1 7/2002 Pham et al.
6,414,594 B1 7/2002 Guerlain
6,430,268 B1 8/2002 Petite
6,433,791 B2 8/2002 Selli et al.
6,437,691 B1 8/2002 Sandelman et al.
6,437,692 B1 8/2002 Petite et al.
6,438,981 B1 8/2002 Whiteside
6,442,953 B1 9/2002 Trigiani et al.
6,449,972 B2 9/2002 Pham et al.
6,450,771 B1 9/2002 Centers et al.
6,451,210 B1 9/2002 Sivavec et al.
6,453,687 B2 9/2002 Sharood et al.
6,454,177 B1 9/2002 Sasao et al.
6,454,538 B1 9/2002 Witham et al.
6,456,928 B1 9/2002 Johnson
6,457,319 B1 10/2002 Ota et al.
6,457,948 B1 10/2002 Pham
6,460,731 B2 10/2002 Estelle et al.
6,462,654 B1 10/2002 Sandelman et al.
6,463,747 B1 10/2002 Temple
6,466,971 B1 10/2002 Humpleman et al.
6,467,280 B2 10/2002 Pham et al.
6,471,486 B1 10/2002 Centers et al.
6,474,084 B2 11/2002 Gauthier et al.
6,484,520 B2 11/2002 Kawaguchi et al.
6,487,457 B1 11/2002 Hull et al.
6,490,506 B1 12/2002 March
6,492,923 B1 12/2002 Inoue et al.
6,497,554 B2 12/2002 Yang et al.
6,501,240 B2 12/2002 Ueda et al.
6,501,629 B1 12/2002 Marriott
6,502,409 B1 1/2003 Gatling et al.
6,505,087 B1 1/2003 Lucas et al.
6,505,475 B1 1/2003 Zugibe et al.
6,510,350 B1 1/2003 Steen, III et al.
6,522,974 B2 2/2003 Sitton
6,523,130 B1 2/2003 Hickman et al.
6,526,766 B1 3/2003 Hiraoka et al.
6,529,590 B1 3/2003 Centers
6,529,839 B1 3/2003 Uggerud et al.
6,533,552 B2 3/2003 Centers et al.
6,535,123 B2 3/2003 Sandelman et al.
6,535,270 B1 3/2003 Murayama
6,535,859 B1 3/2003 Yablonowski et al.
6,537,034 B2 3/2003 Park et al.
6,542,062 B1 4/2003 Herrick
6,549,135 B2 4/2003 Singh et al.
6,551,069 B2 4/2003 Narney, II et al.
6,553,774 B1 4/2003 Ishio et al.
6,558,126 B1 5/2003 Hahn et al.
6,560,976 B2 5/2003 Jayanth
6,571,280 B1 5/2003 Hubacher
6,571,566 B1 6/2003 Temple et al.
6,571,586 B1 6/2003 Ritson et al.
6,574,561 B2 6/2003 Alexander et al.
6,577,959 B1 6/2003 Chajec et al.
6,577,962 B1 6/2003 Afshari
6,578,373 B1 6/2003 Barbier
6,583,720 B1 6/2003 Quigley
6,589,029 B1 7/2003 Heller
6,591,620 B2 7/2003 Kikuchi et al.
6,595,475 B2 7/2003 Svabek et al.
6,595,757 B2 7/2003 Shen
6,598,056 B1 7/2003 Hull et al.
6,601,397 B2 8/2003 Pham et al.
6,604,093 B1 8/2003 Etzion et al.
6,609,070 B1 8/2003 Lueck
6,609,078 B2 8/2003 Starling et al.
6,615,594 B2 9/2003 Jayanth et al.
6,616,415 B1 9/2003 Renken et al.
6,618,578 B1 9/2003 Petite
6,618,709 B1 9/2003 Sneeringer
6,621,443 B1 9/2003 Selli et al.
6,622,925 B2 9/2003 Carner et al.
6,622,926 B1 9/2003 Sartain et al.
6,628,764 B1 9/2003 Petite
6,629,420 B2 10/2003 Renders
6,630,749 B1 10/2003 Takagi et al.
6,631,298 B1 10/2003 Pagnano et al.
6,636,893 B1 10/2003 Fong
6,643,567 B2 11/2003 Kolk et al.
6,644,848 B1 11/2003 Clayton et al.
6,647,735 B2 11/2003 Street et al.
6,658,345 B2 12/2003 Miller
6,658,373 B2 12/2003 Rossi et al.
6,662,584 B1 12/2003 Whiteside
6,662,653 B1 12/2003 Scaliante et al.
6,671,586 B2 12/2003 Davis et al.
6,672,846 B2 1/2004 Rajendran et al.
6,675,591 B2 1/2004 Singh et al.

(56) References Cited

U.S. PATENT DOCUMENTS 6,679,072 B2 1/2004 Pham et al.
6,681,582 B2 * 1/2004 Suzuki ..... B60H 1/3225 62/129
6,684,349 B2 1/2004 Gullo et al.
6,685,438 B2 2/2004 Yoo et al.
6,698,218 B2 3/2004 Goth et al.
6,701,725 B2 3/2004 Rossi et al.
6,708,083 B2 3/2004 Orthlieb et al.
6,708,508 B2 3/2004 Demuth et al.
6,709,244 B2 3/2004 Pham
6,711,470 B1 3/2004 Hartenstein et al.
6,711,911 B1 3/2004 Grabon et al.
6,717,513 B1 4/2004 Sandelman et al.
6,721,770 B1 4/2004 Morton et al.
6,725,182 B2 4/2004 Pagnano et al.
6,732,538 B2 5/2004 Trigiani et al.
6,745,107 B1 6/2004 Miller
6,747,557 B1 6/2004 Petite et al.
6,757,665 B1 6/2004 Unsworth et al.
6,758,050 B2 7/2004 Jayanth et al.
6,758,051 B2 7/2004 Jayanth et al.
6,760,207 B2 7/2004 Wyatt et al.
6,772,096 B2 8/2004 Murakami et al.
6,772,598 B1 8/2004 Rinehart
6,775,995 B1 8/2004 Bahel et al.
6,784,807 B2 8/2004 Petite et al.
6,785,592 B1 8/2004 Smith et al.
6,786,473 B1 9/2004 Alles
6,799,951 B2 10/2004 Lifson et al.
6,804,993 B2 10/2004 Selli
6,811,380 B2 11/2004 Kim
6,813,897 B1 11/2004 Bash et al.
6,816,811 B2 11/2004 Seem
6,823,680 B2 11/2004 Jayanth
6,829,542 B1 12/2004 Reynolds et al.
6,832,120 B1 12/2004 Frank et al.
6,832,898 B2 12/2004 Yoshida et al.
6,836,737 B2 12/2004 Petite et al.
6,837,922 B2 1/2005 Gorin
6,839,790 B2 1/2005 Barros De Almeida et al.
6,854,345 B2 2/2005 Alves et al.
6,862,498 B2 3/2005 Davis et al.
6,868,678 B2 3/2005 Mei et al.
6,868,686 B2 3/2005 Ueda et al.
6,869,272 B2 3/2005 Odachi et al.
6,870,486 B2 3/2005 Souza et al.
6,885,949 B2 4/2005 Selli
6,889,173 B2 5/2005 Singh
6,891,838 B1 5/2005 Petite et al.
6,892,546 B2 5/2005 Singh et al.
6,897,772 B1 5/2005 Scheffler et al.
6,900,738 B2 5/2005 Crichlow
6,901,066 B1 5/2005 Helgeson
6,904,385 B1 6/2005 Budike, Jr.
6,914,533 B2 7/2005 Petite
6,914,893 B2 7/2005 Petite
6,922,155 B1 7/2005 Evans et al.
6,931,445 B2 8/2005 Davis
6,934,862 B2 8/2005 Sharood et al.
6,952,658 B2 10/2005 Greulich et al.
6,953,630 B2 10/2005 Wells
6,956,344 B2 10/2005 Robertson et al.
6,964,558 B2 11/2005 Hahn et al.
6,966,759 B2 11/2005 Hahn et al.
6,968,295 B1 11/2005 Carr
6,973,410 B2 12/2005 Seigel
6,973,793 B2 12/2005 Douglas et al.
6,973,794 B2 12/2005 Street et al.
6,976,366 B2 12/2005 Starling et al.
6,978,225 B2 12/2005 Retlich et al.
6,981,384 B2 1/2006 Dobmeier et al.
6,983,321 B2 1/2006 Trinon et al.
6,983,889 B2 1/2006 Alles
6,986,469 B2 1/2006 Gauthier et al.
6,987,450 B2 1/2006 Marino et al.
6,990,821 B2 1/2006 Singh et al.
6,992,452 B1 1/2006 Sachs et al.
6,996,441 B1 2/2006 Tobias
6,997,390 B2 2/2006 Alles
6,998,807 B2 2/2006 Phillips et al.
6,998,963 B2 2/2006 Flen et al.
6,999,996 B2 2/2006 Sunderland
7,000,422 B2 2/2006 Street et al.
7,003,378 B2 2/2006 Poth
7,009,510 B1 3/2006 Douglass et al.
7,010,925 B2 3/2006 Sienel et al.
7,019,667 B2 3/2006 Petite et al.
7,024,665 B2 4/2006 Ferraz et al.
7,024,870 B2 4/2006 Singh et al.
7,030,752 B2 4/2006 Tyroler
7,031,880 B1 4/2006 Seem et al.
7,035,693 B2 4/2006 Cassiolato et al.
7,039,532 B2 5/2006 Hunter
7,042,180 B2 5/2006 Terry et al.
7,042,350 B2 5/2006 Patrick et al.
7,043,339 B2 5/2006 Maeda et al.
7,043,459 B2 5/2006 Peevey
7,047,753 B2 5/2006 Street et al.
7,053,766 B2 5/2006 Fisler et al.
7,053,767 B2 5/2006 Petite et al.
7,054,271 B2 5/2006 Brownrigg et al.
7,062,580 B2 6/2006 Donaires
7,062,830 B2 6/2006 Alles
7,063,537 B2 6/2006 Selli et al.
7,072,797 B2 7/2006 Gorinevsky
7,075,327 B2 7/2006 Dimino et al.
7,079,810 B2 7/2006 Petite et al.
7,079,967 B2 7/2006 Rossi et al.
7,082,380 B2 7/2006 Wiebe et al.
7,089,125 B2 8/2006 Sonderegger
7,091,847 B2 8/2006 Capowski et al.
7,092,767 B2 8/2006 Pagnano et al.
7,092,794 B1 8/2006 Hill et al.
7,096,153 B2 8/2006 Guralnik et al.
7,102,490 B2 9/2006 Flen et al.
7,103,511 B2 9/2006 Petite
7,110,843 B2 9/2006 Pagnano et al.
7,110,898 B2 9/2006 Montijo et al.
7,113,376 B2 9/2006 Nomura et al.
7,114,343 B2 10/2006 Kates
7,123,020 B2 10/2006 Hill et al.
7,123,458 B2 10/2006 Mohr et al.
7,124,728 B2 10/2006 Carey et al.
7,126,465 B2 10/2006 Faltesek
7,130,170 B2 10/2006 Wakefield et al.
7,130,832 B2 10/2006 Bannai et al.
7,134,295 B2 11/2006 Maekawa
7,137,550 B1 11/2006 Petite
7,142,125 B2 11/2006 Larson et al.
7,145,438 B2 12/2006 Flen et al.
7,145,462 B2 12/2006 Dewing et al.
7,159,408 B2 1/2007 Sadegh et al.
7,162,884 B2 1/2007 Alles
7,163,158 B2 1/2007 Rossi et al.
7,171,372 B2 1/2007 Daniel et al.
7,174,728 B2 2/2007 Jayanth
7,180,412 B2 2/2007 Bonicatto et al.
7,184,861 B2 2/2007 Petite
7,188,482 B2 3/2007 Sadegh et al.
7,188,779 B2 3/2007 Alles
7,201,006 B2 4/2007 Kates
7,207,496 B2 4/2007 Alles
7,209,840 B2 4/2007 Petite et al.
7,212,887 B2 5/2007 Shah et al.
7,222,493 B2 5/2007 Jayanth et al.
7,224,740 B2 5/2007 Hunt
7,225,193 B2 5/2007 Mets et al.
7,227,450 B2 6/2007 Garvy et al.
7,228,691 B2 6/2007 Street et al.
7,230,528 B2 6/2007 Kates
7,234,313 B2 6/2007 Bell et al.
7,236,765 B2 6/2007 Bonicatto et al.
7,244,294 B2 7/2007 Kates
7,246,014 B2 7/2007 Forth et al.

(56) References Cited

U.S. PATENT DOCUMENTS 7,255,285 B2 8/2007 Troost et al.
7,257,501 B2 8/2007 Zhan et al.
7,260,505 B2 8/2007 Felke et al.
7,261,762 B2 8/2007 Kang et al.
7,263,073 B2 8/2007 Petite et al.
7,263,446 B2 8/2007 Morin et al.
7,266,812 B2 9/2007 Pagnano
7,270,278 B2 9/2007 Street et al.
7,274,995 B2 9/2007 Zhan et al.
7,275,377 B2 10/2007 Kates
7,286,945 B2 10/2007 Zhan et al.
7,290,398 B2 11/2007 Wallace et al.
7,290,989 B2 11/2007 Jayanth
7,295,128 B2 11/2007 Petite
7,295,896 B2 11/2007 Norbeck
7,317,952 B2 1/2008 Bhandiwad et al.
7,328,192 B1 2/2008 Stengard et al.
7,330,886 B2 2/2008 Childers et al.
7,331,187 B2 2/2008 Kates
7,336,168 B2 2/2008 Kates
7,337,191 B2 2/2008 Haeberle et al.
7,343,750 B2 3/2008 Lifson et al.
7,343,751 B2 3/2008 Kates
7,346,463 B2 3/2008 Petite et al.
7,346,472 B1 3/2008 Moskowitz et al.
7,349,824 B2 3/2008 Seigel
7,350,112 B2 3/2008 Fox et al.
7,351,274 B2 4/2008 Helt et al.
7,352,545 B2 4/2008 Wyatt et al.
7,363,200 B2 4/2008 Lu
7,376,712 B1 5/2008 Granatelli et al.
7,377,118 B2 5/2008 Esslinger
7,383,030 B2 6/2008 Brown et al.
7,383,158 B2 6/2008 Krocker et al.
7,392,661 B2 7/2008 Alles
7,397,907 B2 7/2008 Petite
7,400,240 B2 7/2008 Shrode et al.
7,412,842 B2 8/2008 Pham
7,414,525 B2 8/2008 Costea et al.
7,421,351 B2 9/2008 Navratil
7,421,374 B2 9/2008 Zhan et al.
7,421,850 B2 9/2008 Street et al.
7,424,343 B2 9/2008 Kates
7,424,345 B2 9/2008 Norbeck
7,424,527 B2 9/2008 Petite
7,432,824 B2 10/2008 Flen et al.
7,433,854 B2 10/2008 Joseph et al.
7,434,742 B2 10/2008 Mueller et al.
7,437,150 B1 10/2008 Morelli et al.
7,440,560 B1 10/2008 Barry
7,440,767 B2 10/2008 Ballay et al.
7,443,313 B2 10/2008 Davis et al.
7,444,251 B2 10/2008 Nikovski et al.
7,445,665 B2 11/2008 Hsieh et al.
7,447,603 B2 11/2008 Bruno
7,447,609 B2 11/2008 Guralnik et al.
7,451,606 B2 11/2008 Harrod
7,454,439 B1 11/2008 Gansner et al.
7,458,223 B2 12/2008 Pham
7,468,661 B2 12/2008 Petite et al.
7,469,546 B2 * 12/2008 Kates ..... F25B 49/005 62/129
7,474,992 B2 1/2009 Ariyur
7,480,501 B2 1/2009 Petite
7,483,810 B2 1/2009 Jackson et al.
7,484,376 B2 2/2009 Pham
7,490,477 B2 2/2009 Singh et al.
7,491,034 B2 2/2009 Jayanth
7,503,182 B2 3/2009 Bahel et al.
7,510,126 B2 3/2009 Rossi et al.
7,523,619 B2 4/2009 Kojima et al.
7,528,711 B2 5/2009 Kates
7,533,070 B2 5/2009 Guralnik et al.
7,537,172 B2 5/2009 Rossi et al.
7,552,030 B2 6/2009 Guralnik et al.
7,552,596 B2 * 6/2009 Galante ..... F25B 45/00 62/127
7,555,364 B2 6/2009 Poth et al.
7,574,333 B2 8/2009 Lu
7,580,812 B2 8/2009 Ariyur et al.
7,594,407 B2 9/2009 Singh et al.
7,596,959 B2 10/2009 Singh et al.
7,606,683 B2 10/2009 Bahel et al.
7,631,508 B2 12/2009 Braun et al.
7,636,901 B2 12/2009 Munson et al.
7,644,591 B2 1/2010 Singh et al.
7,648,077 B2 1/2010 Rossi et al.
7,648,342 B2 1/2010 Jayanth
7,650,425 B2 1/2010 Davis et al.
7,660,700 B2 2/2010 Moskowitz et al.
7,660,774 B2 2/2010 Mukherjee et al.
7,664,613 B2 2/2010 Hansen
7,665,315 B2 2/2010 Singh et al.
7,686,872 B2 3/2010 Kang
7,693,809 B2 4/2010 Gray
7,697,492 B2 4/2010 Petite
7,703,694 B2 4/2010 Mueller et al.
7,704,052 B2 4/2010 Iimura et al.
7,706,320 B2 4/2010 Davis et al.
7,724,131 B2 5/2010 Chen
7,726,583 B2 6/2010 Maekawa
7,734,451 B2 6/2010 MacArthur et al.
7,738,999 B2 6/2010 Petite
7,739,378 B2 6/2010 Petite
7,742,393 B2 6/2010 Bonicatto et al.
7,752,853 B2 7/2010 Singh et al.
7,752,854 B2 7/2010 Singh et al.
7,756,086 B2 7/2010 Petite et al.
7,791,468 B2 9/2010 Bonicatto et al.
7,844,366 B2 11/2010 Singh
7,845,179 B2 12/2010 Singh et al.
7,848,827 B2 12/2010 Chen
7,848,900 B2 12/2010 Steinberg et al.
7,877,218 B2 1/2011 Bonicatto et al.
7,878,006 B2 2/2011 Pham
7,885,959 B2 2/2011 Horowitz et al.
7,885,961 B2 2/2011 Horowitz et al.
7,905,098 B2 3/2011 Pham
7,908,116 B2 3/2011 Steinberg et al.
7,908,117 B2 3/2011 Steinberg et al.
7,922,914 B1 4/2011 Verdegan et al.
7,937,623 B2 5/2011 Ramacher et al.
7,941,294 B2 5/2011 Shahi et al.
7,949,494 B2 5/2011 Moskowitz et al.
7,949,615 B2 5/2011 Ehlers et al.
7,963,454 B2 6/2011 Sullivan et al.
7,966,152 B2 6/2011 Stluka et al.
7,967,218 B2 6/2011 Alles
7,978,059 B2 7/2011 Petite et al.
7,987,679 B2 8/2011 Tanaka et al.
7,996,045 B1 8/2011 Bauer et al.
7,999,668 B2 8/2011 Cawthorne et al.
8,000,314 B2 8/2011 Brownrigg et al.
8,002,199 B2 8/2011 Habegger
8,005,640 B2 8/2011 Chiefetz et al.
8,010,237 B2 8/2011 Cheung et al.
8,013,732 B2 9/2011 Petite et al.
8,018,182 B2 9/2011 Roehm et al.
8,019,567 B2 9/2011 Steinberg et al.
8,029,608 B1 10/2011 Breslin
8,031,455 B2 10/2011 Paik et al.
8,031,650 B2 10/2011 Petite et al.
8,034,170 B2 10/2011 Kates
8,036,844 B2 10/2011 Ling et al.
8,040,231 B2 10/2011 Kuruvila et al.
8,041,539 B2 10/2011 Guralnik et al.
8,046,107 B2 10/2011 Zugibe et al.
8,061,417 B2 11/2011 Gray
8,064,412 B2 11/2011 Petite
8,065,886 B2 11/2011 Singh et al.
8,068,997 B2 11/2011 Ling et al.
8,090,477 B1 1/2012 Steinberg
8,090,559 B2 1/2012 Parthasarathy et al.
8,090,824 B2 1/2012 Tran et al.

(56) References Cited

U.S. PATENT DOCUMENTS 8,095,337 B2 1/2012 Kolbet et al.
8,108,200 B2 1/2012 Anne et al.
8,125,230 B2 2/2012 Bharadwaj et al.
8,131,497 B2 3/2012 Steinberg et al.
8,131,506 B2 3/2012 Steinberg et al.
8,134,330 B2 3/2012 Alles
8,150,720 B2 4/2012 Singh et al.
8,156,208 B2 4/2012 Bornhoevd et al.
8,160,827 B2 4/2012 Jayanth et al.
8,170,968 B2 5/2012 Colclough et al.
8,171,136 B2 5/2012 Petite
8,175,846 B2 5/2012 Khalak et al.
8,180,492 B2 5/2012 Steinberg
8,182,579 B2 5/2012 Woo et al.
8,214,175 B2 7/2012 Moskowitz et al.
8,228,648 B2 7/2012 Jayanth et al.
8,239,922 B2 8/2012 Sullivan et al.
8,258,763 B2 9/2012 Nakamura et al.
8,279,565 B2 10/2012 Hall et al.
8,280,536 B1 10/2012 Fadell et al.
8,328,524 B2 12/2012 Iimura et al.
8,335,657 B2 12/2012 Jayanth et al.
8,380,556 B2 2/2013 Singh et al.
8,393,169 B2 3/2013 Pham
8,625,244 B2 1/2014 Paik et al.
9,046,900 B2 6/2015 Kates
9,168,315 B1 10/2015 Scaringe et al.
9,304,521 B2 4/2016 Kates
9,310,094 B2 4/2016 Kates
9,310,439 B2 4/2016 Pham et al.
9,690,307 B2 6/2017 Kates
9,765,979 B2 9/2017 Alsaleem et al.
2001/0005320 A1 6/2001 Ueda et al.
2001/0023596 A1 9/2001 Fujita et al.
2001/0025349 A1 9/2001 Sharood et al.
2001/0054291 A1 12/2001 Roh et al.
2001/0054293 A1 12/2001 Gustafson et al.
2001/0054294 A1 12/2001 Tsuboi
2002/0000092 A1 1/2002 Sharood et al.
2002/0013679 A1 1/2002 Petite
2002/0016639 A1 2/2002 Smith et al.
2002/0017057 A1 2/2002 Weder
2002/0018724 A1 2/2002 Millet et al.
2002/0020175 A1 2/2002 Street et al.
2002/0029575 A1 3/2002 Okamoto
2002/0031101 A1 3/2002 Petite et al.
2002/0035495 A1 3/2002 Spira et al.
2002/0040280 A1 4/2002 Morgan
2002/0059803 A1 5/2002 Jayanth
2002/0064463 A1 5/2002 Park et al.
2002/0067999 A1 6/2002 Suitou et al.
2002/0082747 A1 6/2002 Kramer
2002/0082924 A1 6/2002 Koether
2002/0093259 A1 7/2002 Sunaga et al.
2002/0095269 A1 7/2002 Natalini et al.
2002/0103655 A1 8/2002 Boies et al.
2002/0108384 A1 8/2002 Higashiyama
2002/0113877 A1 8/2002 Welch
2002/0117992 A1 8/2002 Hirono et al.
2002/0118106 A1 8/2002 Brenn
2002/0127120 A1 9/2002 Hahn et al.
2002/0138217 A1 9/2002 Shen et al.
2002/0139128 A1 10/2002 Suzuki et al.
2002/0143482 A1 10/2002 Karanam et al.
2002/0152298 A1 10/2002 Kikta et al.
2002/0157408 A1 10/2002 Egawa et al.
2002/0157409 A1 10/2002 Pham et al.
2002/0159890 A1 10/2002 Kajiwara et al.
2002/0161545 A1 10/2002 Starling et al.
2002/0163436 A1 11/2002 Singh et al.
2002/0170299 A1 11/2002 Jayanth et al.
2002/0173929 A1 11/2002 Seigel
2002/0187057 A1 12/2002 Loprete et al.
2002/0189267 A1 12/2002 Singh et al.
2002/0193890 A1 12/2002 Pouchak
2002/0198629 A1 12/2002 Ellis
2003/0004660 A1 1/2003 Hunter
2003/0004765 A1 1/2003 Wiegand
2003/0005710 A1 1/2003 Singh et al.
2003/0006884 A1 1/2003 Hunt
2003/0014218 A1 1/2003 Trigiani et al.
2003/0019221 A1 1/2003 Rossi et al.
2003/0036810 A1 2/2003 Petite
2003/0037555 A1 2/2003 Street et al.
2003/0050737 A1 3/2003 Osann
2003/0050824 A1 3/2003 Suermondt et al.
2003/0051490 A1 3/2003 Jayanth
2003/0055603 A1 3/2003 Rossi et al.
2003/0055663 A1 3/2003 Struble
2003/0061825 A1 4/2003 Sullivan
2003/0063983 A1 4/2003 Ancel et al.
2003/0070438 A1 4/2003 Kikuchi et al.
2003/0070544 A1 4/2003 Mulvaney et al.
2003/0074285 A1 4/2003 Hoffman et al.
2003/0077179 A1 4/2003 Collins et al.
2003/0078677 A1 4/2003 Hull et al.
2003/0078742 A1 4/2003 VanderZee et al.
2003/0089493 A1 5/2003 Takano et al.
2003/0094004 A1 5/2003 Pham et al.
2003/0108430 A1 6/2003 Yoshida et al.
2003/0115890 A1 6/2003 Jayanth et al.
2003/0135786 A1 7/2003 Vollmar et al.
2003/0137396 A1 7/2003 Durej et al.
2003/0150924 A1 8/2003 Peter
2003/0150926 A1 8/2003 Rosen
2003/0150927 A1 8/2003 Rosen
2003/0171851 A1 9/2003 Brickfield et al.
2003/0183085 A1 10/2003 Alexander
2003/0191606 A1 10/2003 Fujiyama et al.
2003/0199247 A1 10/2003 Striemer
2003/0205143 A1 11/2003 Cheng
2003/0213256 A1 11/2003 Ueda et al.
2003/0213851 A1 11/2003 Burd et al.
2003/0216837 A1 11/2003 Reich et al.
2003/0216888 A1 11/2003 Ridolfo
2003/0233172 A1 12/2003 Granqvist et al.
2004/0016241 A1 1/2004 Street et al.
2004/0016244 A1 1/2004 Street et al.
2004/0016251 A1 1/2004 Street et al.
2004/0016253 A1 1/2004 Street et al.
2004/0019584 A1 1/2004 Greening et al.
2004/0024495 A1 2/2004 Sunderland
2004/0026522 A1 2/2004 Keen et al.
2004/0037706 A1 2/2004 Hahn et al.
2004/0042904 A1 3/2004 Kim
2004/0047406 A1 3/2004 Hunt
2004/0049715 A1 3/2004 Jaw
2004/0059691 A1 3/2004 Higgins
2004/0068390 A1 4/2004 Saunders
2004/0078695 A1 4/2004 Bowers et al.
2004/0079093 A1 4/2004 Gauthier et al.
2004/0093879 A1 5/2004 Street et al.
2004/0095237 A1 5/2004 Chen et al.
2004/0111186 A1 6/2004 Rossi et al.
2004/0117166 A1 6/2004 Cassiolato
2004/0133314 A1 7/2004 Ehlers et al.
2004/0133367 A1 7/2004 Hart
2004/0140772 A1 7/2004 Gullo et al.
2004/0140812 A1 7/2004 Scallante et al.
2004/0144106 A1 7/2004 Douglas et al.
2004/0153437 A1 8/2004 Buchan
2004/0159113 A1 8/2004 Singh et al.
2004/0159114 A1* 8/2004 Demuth ..... B60H 1/00978 62/129
2004/0183687 A1 9/2004 Petite et al.
2004/0184627 A1 9/2004 Kost et al.
2004/0184928 A1 9/2004 Millet et al.
2004/0184929 A1 9/2004 Millet et al.
2004/0184930 A1 9/2004 Millet et al.
2004/0184931 A1 9/2004 Millet et al.
2004/0187502 A1 9/2004 Jayanth et al.
2004/0191073 A1 9/2004 Iimura et al.
2004/0199480 A1 10/2004 Unsworth et al.
2004/0210419 A1 10/2004 Wiebe et al.

(56) References Cited

U.S. PATENT DOCUMENTS

2004/0213384 A1 10/2004 Alles et al.
2004/0230582 A1 11/2004 Pagnano et al.
2004/0230899 A1 11/2004 Pagnano et al.
2004/0239266 A1 12/2004 Lee et al.
2004/0258542 A1 12/2004 Wiertz et al.
2004/0261431 A1 12/2004 Singh et al.
2005/0040249 A1 2/2005 Wacker et al.
2005/0043923 A1 2/2005 Forster et al.
2005/0053471 A1 3/2005 Hong et al.
2005/0056031 A1 3/2005 Jeong
2005/0066675 A1 3/2005 Manole et al.
2005/0073532 A1 4/2005 Scott et al.
2005/0086341 A1 4/2005 Enga et al.
2005/0100449 A1 5/2005 Hahn et al.
2005/0103036 A1 5/2005 Maekawa
2005/0125439 A1 6/2005 Nourbakhsh et al.
2005/0126190 A1 6/2005 Lifson et al.
2005/0131624 A1 6/2005 Gaessler et al.
2005/0149570 A1 7/2005 Sasaki et al.
2005/0154495 A1 7/2005 Shah
2005/0159924 A1 7/2005 Shah et al.
2005/0166610 A1 8/2005 Jayanth
2005/0169636 A1 8/2005 Aronson et al.
2005/0172647 A1 8/2005 Thybo et al.
2005/0188842 A1 9/2005 Hsieh et al.
2005/0195775 A1 9/2005 Petite et al.
2005/0196285 A1 9/2005 Jayanth
2005/0198063 A1 9/2005 Thomas et al.
2005/0201397 A1 9/2005 Petite
2005/0204756 A1 9/2005 Dobmeier et al.
2005/0207741 A1 9/2005 Shah et al.
2005/0214148 A1 9/2005 Ogawa et al.
2005/0222715 A1 10/2005 Ruhnke et al.
2005/0228607 A1 10/2005 Simons
2005/0229612 A1 10/2005 Hrejsa et al.
2005/0229777 A1 10/2005 Brown et al.
2005/0232781 A1 10/2005 Herbert et al.
2005/0235660 A1 10/2005 Pham
2005/0235661 A1 10/2005 Pham
2005/0235662 A1 10/2005 Pham
2005/0235663 A1 10/2005 Pham
2005/0235664 A1 10/2005 Pham
2005/0247194 A1 11/2005 Kang et al.
2005/0251293 A1 11/2005 Seigel
2005/0252220 A1 11/2005 Street et al.
2005/0262856 A1 12/2005 Street et al.
2005/0262923 A1 12/2005 Kates
2005/0279110 A1 12/2005 Zeng et al.
2006/0010898 A1 1/2006 Suharno et al.
2006/0015777 A1 1/2006 Loda
2006/0020426 A1 1/2006 Singh
2006/0021362 A1 2/2006 Sadegh et al.
2006/0032245 A1 2/2006 Kates
2006/0032246 A1 2/2006 Kates
2006/0032247 A1 2/2006 Kates
2006/0032248 A1 2/2006 Kates
2006/0032379 A1 2/2006 Kates
2006/0036349 A1 2/2006 Kates
2006/0041335 A9 2/2006 Rossi et al.
2006/0042276 A1 3/2006 Doll et al.
2006/0071089 A1 4/2006 Kates
2006/0071666 A1 4/2006 Unsworth et al.
2006/0074917 A1 4/2006 Chand et al.
2006/0097063 A1 5/2006 Zeevi
2006/0098576 A1 5/2006 Brownrigg et al.
2006/0117773 A1 6/2006 Street et al.
2006/0123807 A1 6/2006 Sullivan et al.
2006/0129339 A1 6/2006 Bruno
2006/0130500 A1 6/2006 Gauthier et al.
2006/0137364 A1 6/2006 Braun et al.
2006/0137368 A1* 6/2006 Kang ..... F25B 45/00 62/149
2006/0138866 A1 6/2006 Bergmann et al.
2006/0140209 A1 6/2006 Cassiolato et al.
2006/0151037 A1 7/2006 Lepola et al.
2006/0179854 A1 8/2006 Esslinger
2006/0182635 A1 8/2006 Jayanth
2006/0185373 A1 8/2006 Butler et al.
2006/0196196 A1 9/2006 Kates
2006/0196197 A1 9/2006 Kates
2006/0201168 A1 9/2006 Kates
2006/0222507 A1 10/2006 Jayanth
2006/0229739 A1 10/2006 Morikawa
2006/0235650 A1 10/2006 Vinberg et al.
2006/0238388 A1 10/2006 Jayanth
2006/0242200 A1 10/2006 Horowitz et al.
2006/0244641 A1 11/2006 Jayanth et al.
2006/0256488 A1 11/2006 Benzing et al.
2006/0259276 A1 11/2006 Rossi et al.
2006/0271589 A1 11/2006 Horowitz et al.
2006/0271623 A1 11/2006 Horowitz et al.
2006/0280627 A1 12/2006 Jayanth
2007/0002505 A1 1/2007 Watanabe et al.
2007/0006124 A1 1/2007 Ahmed et al.
2007/0027735 A1 2/2007 Rokos
2007/0067512 A1 3/2007 Donaires et al.
2007/0089434 A1 4/2007 Singh et al.
2007/0089435 A1 4/2007 Singh et al.
2007/0089438 A1 4/2007 Singh et al.
2007/0089439 A1 4/2007 Singh et al.
2007/0089440 A1 4/2007 Singh et al.
2007/0101750 A1 5/2007 Pham et al.
2007/0159978 A1 7/2007 Anglin et al.
2007/0186569 A1 8/2007 Street et al.
2007/0204635 A1 9/2007 Tanaka et al.
2007/0204921 A1 9/2007 Alles
2007/0205296 A1 9/2007 Bell et al.
2007/0229305 A1 10/2007 Bonicatto et al.
2007/0239894 A1 10/2007 Thind et al.
2008/0000241 A1 1/2008 Larsen et al.
2008/0015797 A1 1/2008 Kates
2008/0016888 A1 1/2008 Kates
2008/0033674 A1 2/2008 Nikovski et al.
2008/0051945 A1 2/2008 Kates
2008/0058970 A1 3/2008 Perumalsamy et al.
2008/0078289 A1 4/2008 Sergi et al.
2008/0109185 A1 5/2008 Cheung et al.
2008/0110189 A1 5/2008 Alston et al.
2008/0114569 A1 5/2008 Seigel
2008/0121729 A1 5/2008 Gray
2008/0183424 A1 7/2008 Seem
2008/0186898 A1 8/2008 Petite
2008/0209925 A1 9/2008 Pham
2008/0216494 A1 9/2008 Pham et al.
2008/0216495 A1 9/2008 Kates
2008/0223051 A1 9/2008 Kates
2008/0234869 A1 9/2008 Yonezawa et al.
2008/0315000 A1* 12/2008 Gorthala ..... B60H 1/00785 236/46 C
2008/0319688 A1 12/2008 Kim
2009/0007777 A1 1/2009 Cohen et al.
2009/0030555 A1 1/2009 Gray
2009/0037142 A1 2/2009 Kates
2009/0038010 A1 2/2009 Ma et al.
2009/0055465 A1 2/2009 DePue et al.
2009/0057424 A1 3/2009 Sullivan et al.
2009/0057428 A1 3/2009 Geadelmann et al.
2009/0068947 A1 3/2009 Petite
2009/0071175 A1 3/2009 Pham
2009/0072985 A1 3/2009 Patel et al.
2009/0093916 A1 4/2009 Parsonnet et al.
2009/0094998 A1 4/2009 McSweeney et al.
2009/0096605 A1 4/2009 Petite et al.
2009/0099699 A1 4/2009 Steinberg et al.
2009/0106601 A1 4/2009 Ngai et al.
2009/0112672 A1 4/2009 Flamig et al.
2009/0114309 A1* 5/2009 Sakai ..... F25B 45/00 141/1
2009/0119036 A1 5/2009 Jayanth et al.
2009/0125151 A1 5/2009 Steinberg et al.
2009/0125257 A1 5/2009 Jayanth et al.
2009/0140880 A1 6/2009 Flen et al.
2009/0151374 A1 6/2009 Kasahara
2009/0187281 A1 7/2009 Kates

(56) References Cited

U.S. PATENT DOCUMENTS

2009/0215424 A1 8/2009 Petite
2009/0229469 A1 9/2009 Campbell et al.
2009/0241570 A1 10/2009 Kuribayashi et al.
2009/0296832 A1 12/2009 Hunt
2009/0324428 A1 12/2009 Tolbert, Jr. et al.
2010/0006042 A1 1/2010 Pitonyak et al.
2010/0011962 A1 1/2010 Totsugi
2010/0017465 A1 1/2010 Brownrigg et al.
2010/0039984 A1 2/2010 Brownrigg
2010/0044449 A1 2/2010 Tessier
2010/0070084 A1 3/2010 Steinberg et al.
2010/0070234 A1 3/2010 Steinberg et al.
2010/0070666 A1 3/2010 Brindle
2010/0078493 A1 4/2010 Alles
2010/0081357 A1 4/2010 Alles
2010/0081372 A1 4/2010 Alles
2010/0089076 A1 4/2010 Schuster et al.
2010/0102136 A1 4/2010 Hadzidedic et al.
2010/0111709 A1 5/2010 Jayanth
2010/0168924 A1 7/2010 Tessier et al.
2010/0169030 A1 7/2010 Parlos
2010/0179703 A1 7/2010 Singh et al.
2010/0191487 A1 7/2010 Rada et al.
2010/0194582 A1 8/2010 Petite
2010/0214709 A1 8/2010 Hall et al.
2010/0217550 A1 8/2010 Crabtree et al.
2010/0250054 A1 9/2010 Petite
2010/0257410 A1 10/2010 Cottrell et al.
2010/0262299 A1 10/2010 Cheung et al.
2010/0265909 A1 10/2010 Petite et al.
2010/0280667 A1 11/2010 Steinberg
2010/0282857 A1 11/2010 Steinberg
2010/0287489 A1 11/2010 Alles
2010/0293397 A1 11/2010 Pham et al.
2010/0305718 A1 12/2010 Clark et al.
2010/0308119 A1 12/2010 Steinberg et al.
2010/0312881 A1 12/2010 Davis et al.
2010/0318227 A1 12/2010 Steinberg et al.
2010/0330985 A1 12/2010 Addy
2011/0004350 A1 1/2011 Cheifetz et al.
2011/0022429 A1 1/2011 Yates et al.
2011/0023045 A1 1/2011 Yates et al.
2011/0023945 A1 2/2011 Hayashi et al.
2011/0040785 A1 2/2011 Steenberg et al.
2011/0042541 A1 2/2011 Spencer et al.
2011/0045454 A1 2/2011 McManus et al.
2011/0054842 A1 3/2011 Kates
2011/0071960 A1 3/2011 Singh
2011/0077896 A1 3/2011 Steinberg et al.
2011/0083450 A1 4/2011 Turner et al.
2011/0102159 A1 5/2011 Olson et al.
2011/0103460 A1 5/2011 Bonicatto
2011/0106471 A1 5/2011 Curtis et al.
2011/0112814 A1 5/2011 Clark
2011/0118905 A1 5/2011 Mylaraswamy et al.
2011/0121952 A1 5/2011 Bonicatto et al.
2011/0144932 A1 6/2011 Alles
2011/0144944 A1 6/2011 Pham
2011/0166828 A1 7/2011 Steinberg et al.
2011/0181438 A1 7/2011 Millstein et al.
2011/0184563 A1 7/2011 Foslien et al.
2011/0185895 A1 8/2011 Freen
2011/0190910 A1 8/2011 Lombard et al.
2011/0212700 A1 9/2011 Petite
2011/0218957 A1 9/2011 Coon et al.
2011/0264324 A1 10/2011 Petite et al.
2011/0264409 A1 10/2011 Jayanth et al.
2011/0290893 A1 12/2011 Steinberg
2011/0307103 A1 12/2011 Cheung et al.
2011/0309953 A1 12/2011 Petite et al.
2011/0310929 A1 12/2011 Petite et al.
2011/0315019 A1 12/2011 Lyon et al.
2011/0320050 A1 12/2011 Petite et al.
2012/0005590 A1 1/2012 Lombard et al.
2012/0054242 A1 3/2012 Ferrara et al.
2012/0065783 A1 3/2012 Fadell et al.
2012/0065935 A1 3/2012 Steinberg et al.
2012/0066168 A1 3/2012 Fadell et al.
2012/0075092 A1 3/2012 Petite et al.
2012/0092154 A1 4/2012 Petite
2012/0125559 A1 5/2012 Fadell et al.
2012/0125592 A1 5/2012 Fadell et al.
2012/0126019 A1 5/2012 Warren et al.
2012/0126020 A1 5/2012 Filson et al.
2012/0126021 A1 5/2012 Warren et al.
2012/0128025 A1 5/2012 Huppi et al.
2012/0130546 A1 5/2012 Matas et al.
2012/0130547 A1 5/2012 Fadell et al.
2012/0130548 A1 5/2012 Fadell et al.
2012/0130679 A1 5/2012 Fadell et al.
2012/0131504 A1 5/2012 Fadell et al.
2012/0143528 A1 6/2012 Kates
2012/0179300 A1 7/2012 Warren et al.
2012/0186774 A1 7/2012 Matsuoka et al.
2012/0191257 A1 7/2012 Corcoran et al.
2012/0199660 A1 8/2012 Warren et al.
2012/0203379 A1 8/2012 Sloo et al.
2012/0221150 A1 8/2012 Arensmeier
2012/0229521 A1 9/2012 Hales, IV et al.
2012/0232969 A1 9/2012 Fadell et al.
2012/0233478 A1 9/2012 Mucignat et al.
2012/0239207 A1 9/2012 Fadell et al.
2012/0239221 A1 9/2012 Mighdoll et al.
2012/0245968 A1 9/2012 Beaulieu et al.
2012/0248210 A1 10/2012 Warren et al.
2012/0248211 A1 10/2012 Warren et al.
2012/0260804 A1 10/2012 Kates
2012/0265491 A1 10/2012 Drummy
2012/0265586 A1 10/2012 Mammone
2012/0271673 A1 10/2012 Riley
2012/0291629 A1 11/2012 Tylutki et al.
2012/0318135 A1 12/2012 Hoglund et al.
2012/0318137 A1 12/2012 Ragland et al.
2013/0066479 A1 3/2013 Shetty et al.
2013/0156607 A1 6/2013 Jayanth
2013/0166231 A1 6/2013 Jayanth et al.
2013/0174588 A1 7/2013 Pham
2013/0176649 A1 7/2013 Wallis et al.
2013/0182285 A1 7/2013 Matsuhara et al.
2013/0287063 A1 10/2013 Kates
2013/0294933 A1 11/2013 Pham
2014/0000290 A1 1/2014 Kates
2014/0000291 A1 1/2014 Kates
2014/0000292 A1 1/2014 Kates
2014/0000293 A1 1/2014 Kates
2014/0000294 A1 1/2014 Kates
2014/0012422 A1 1/2014 Kates
2014/0069121 A1 3/2014 Pham
2014/0074730 A1 3/2014 Arensmeier et al.
2014/0084836 A1 3/2014 Pham et al.
2014/0229014 A1 8/2014 Pham et al.
2014/0260342 A1 9/2014 Pham
2014/0260390 A1 9/2014 Pham
2014/0262134 A1 9/2014 Arensmeier et al.
2014/0266755 A1 9/2014 Arensmeier et al.
2014/0297208 A1 10/2014 Arensmeier
2014/0299289 A1 10/2014 Alsaleem et al.
2015/0135748 A1 5/2015 Alsaleem et al.
2015/0155701 A1 6/2015 Wallis et al.
2015/0261230 A1 9/2015 Kates
2015/0367463 A1 12/2015 Pham
2016/0076536 A1 3/2016 Jayanth et al.
2016/0223238 A1 8/2016 Kates
2016/0226416 A1 8/2016 Pham et al.
2017/0179709 A1 6/2017 Wallis et al.
2017/0266769 A1 9/2017 Pham
2017/0308072 A1 10/2017 Arensmeier
2018/0045445 A1 2/2018 Pham
2018/0129233 A1 5/2018 Kates

FOREIGN PATENT DOCUMENTS

CA 2528778 A1 12/2004
CA 2567264 A1 7/2007

(56) References Cited

FOREIGN PATENT DOCUMENTS

| | | | |
|---|---|---|---|
| CH | 173493 | A | 11/1934 |
| CN | 1133425 | A | 10/1996 |
| CN | 1169619 | A | 1/1998 |
| CN | 1297522 | A | 5/2001 |
| CN | 1354347 | A | 6/2002 |
| CN | 1356472 | A | 7/2002 |
| CN | 1654893 | A | 8/2005 |
| CN | 1742427 | A | 3/2006 |
| CN | 1906453 | A | 1/2007 |
| CN | 1922445 | A | 2/2007 |
| CN | 101048713 | A | 10/2007 |
| CN | 101124436 | A | 2/2008 |
| CN | 101156033 | A | 4/2008 |
| CN | 101270908 | A | 9/2008 |
| CN | 101361244 | A | 2/2009 |
| CN | 101466193 | A | 6/2009 |
| CN | 101506600 | A | 8/2009 |
| CN | 101802521 | A | 8/2010 |
| CN | 101821693 | A | 9/2010 |
| CN | 102354206 | A | 2/2012 |
| DE | 842351 | C | 6/1952 |
| DE | 764179 | C | 4/1953 |
| DE | 1144461 | B | 2/1963 |
| DE | 1403516 | A1 | 10/1968 |
| DE | 1403467 | A1 | 10/1969 |
| DE | 3118638 | A1 | 5/1982 |
| DE | 3133502 | A1 | 6/1982 |
| DE | 3508353 | A1 | 9/1985 |
| DE | 3422398 | A1 | 12/1985 |
| DE | 29723145 | U1 | 4/1998 |
| EP | 0008524 | A1 | 3/1980 |
| EP | 0060172 | A1 | 9/1982 |
| EP | 0085246 | A1 | 8/1983 |
| EP | 0124603 | A1 | 11/1984 |
| EP | 0254253 | A2 | 1/1988 |
| EP | 0346152 | A2 | 12/1989 |
| EP | 0351272 | A1 | 1/1990 |
| EP | 0351833 | A2 | 1/1990 |
| EP | 0355255 | A2 | 2/1990 |
| EP | 0361394 | A2 | 4/1990 |
| EP | 0398436 | A1 | 11/1990 |
| EP | 0410330 | A2 | 1/1991 |
| EP | 0419857 | A2 | 4/1991 |
| EP | 0432085 | A2 | 6/1991 |
| EP | 0453302 | A1 | 10/1991 |
| EP | 0479421 | A1 | 4/1992 |
| EP | 0557023 | A1 | 8/1993 |
| EP | 0579374 | A1 | 1/1994 |
| EP | 0660213 | A2 | 6/1995 |
| EP | 0747598 | A2 | 12/1996 |
| EP | 0877462 | A2 | 11/1998 |
| EP | 0982497 | A1 | 3/2000 |
| EP | 1008816 | A2 | 6/2000 |
| EP | 1087142 | A2 | 3/2001 |
| EP | 1087184 | A2 | 3/2001 |
| EP | 1138949 | A2 | 10/2001 |
| EP | 1139037 | A1 | 10/2001 |
| EP | 1187021 | A2 | 3/2002 |
| EP | 1209427 | A1 | 5/2002 |
| EP | 1241417 | A1 | 9/2002 |
| EP | 1245912 | A2 | 10/2002 |
| EP | 1245913 | A1 | 10/2002 |
| EP | 1393034 | A1 | 3/2004 |
| EP | 1435002 | A1 | 7/2004 |
| EP | 1487077 | A2 | 12/2004 |
| EP | 1541869 | A1 | 6/2005 |
| EP | 2180270 | A1 | 4/2010 |
| FR | 2472862 | A1 | 7/1981 |
| FR | 2582430 | A1 | 11/1986 |
| FR | 2589561 | A1 | 5/1987 |
| FR | 2628558 | A1 | 9/1989 |
| FR | 2660739 | A1 | 10/1991 |
| GB | 2062919 | A | 5/1981 |
| GB | 2064818 | A | 6/1981 |
| GB | 2075774 | A | 11/1981 |
| GB | 2116635 | A | 9/1983 |
| GB | 2229295 | A | 9/1990 |
| GB | 2347217 | A | 8/2000 |
| JP | 56010639 | A | 2/1981 |
| JP | 59145392 | A | 8/1984 |
| JP | 61046485 | A | 3/1986 |
| JP | 62116844 | A | 5/1987 |
| JP | 63061783 | A | 3/1988 |
| JP | 63302238 | A | 12/1988 |
| JP | 01014554 | A | 1/1989 |
| JP | 02110242 | A | 4/1990 |
| JP | 02294580 | A | 12/1990 |
| JP | 04080578 | A | 3/1992 |
| JP | 06058273 | A | 3/1994 |
| JP | 08021675 | A | 1/1996 |
| JP | 08087229 | A | 4/1996 |
| JP | 08261541 | A | 10/1996 |
| JP | 08284842 | A | 10/1996 |
| JP | 2000350490 | A | 12/2000 |
| JP | 2002155868 | A | 5/2002 |
| JP | 2003018883 | A | 1/2003 |
| JP | 2003176788 | A | 6/2003 |
| JP | 2004316504 | A | 11/2004 |
| JP | 2005188790 | A | 7/2005 |
| JP | 2005241089 | A | 9/2005 |
| JP | 2005345096 | A | 12/2005 |
| JP | 2006046219 | A | 2/2006 |
| JP | 2006046519 | A | 2/2006 |
| JP | 2006274807 | A | 10/2006 |
| JP | 2009002651 | A | 1/2009 |
| JP | 2009229184 | A | 10/2009 |
| JP | 2010048433 | A | 3/2010 |
| KR | 1019980036844 | A | 8/1998 |
| KR | 1020000000261 | A | 1/2000 |
| KR | 1020000025265 | | 5/2000 |
| KR | 1020020041977 | | 6/2002 |
| KR | 20030042857 | A | 6/2003 |
| KR | 1020040021281 | | 3/2004 |
| KR | 1020060020353 | | 3/2006 |
| RU | 30009 | U1 | 6/2003 |
| RU | 55218 | U1 | 7/2006 |
| WO | WO-8601262 | A1 | 2/1986 |
| WO | WO-8703988 | A1 | 7/1987 |
| WO | WO-8705097 | A1 | 8/1987 |
| WO | WO-8802527 | A1 | 4/1988 |
| WO | WO-8806703 | A1 | 9/1988 |
| WO | WO-9718636 | A2 | 5/1997 |
| WO | WO-9748161 | A1 | 12/1997 |
| WO | WO-9917066 | A1 | 4/1999 |
| WO | WO-9961847 | A1 | 12/1999 |
| WO | WO-9965681 | A1 | 12/1999 |
| WO | WO-0021047 | A1 | 4/2000 |
| WO | WO-0051223 | A1 | 8/2000 |
| WO | WO-0169147 | A1 | 9/2001 |
| WO | WO-0214968 | A1 | 2/2002 |
| WO | WO-0249178 | A2 | 6/2002 |
| WO | WO-0275227 | A1 | 9/2002 |
| WO | WO-02090840 | A2 | 11/2002 |
| WO | WO-02090913 | A1 | 11/2002 |
| WO | WO-02090914 | A1 | 11/2002 |
| WO | WO-03031996 | A1 | 4/2003 |
| WO | WO-03090000 | A1 | 10/2003 |
| WO | WO-04049088 | A1 | 6/2004 |
| WO | WO-2005022049 | A2 | 3/2005 |
| WO | WO-2005065355 | A2 | 7/2005 |
| WO | WO-05073686 | A1 | 8/2005 |
| WO | WO-2005108882 | A2 | 11/2005 |
| WO | WO-06023075 | A2 | 3/2006 |
| WO | WO-2006025880 | A1 | 3/2006 |
| WO | WO-2006091521 | A2 | 8/2006 |
| WO | WO-2008010988 | A1 | 1/2008 |
| WO | WO-2008079108 | A1 | 7/2008 |
| WO | WO-08144864 | A1 | 12/2008 |
| WO | WO-2009058356 | A1 | 5/2009 |
| WO | WO-2009061370 | A1 | 5/2009 |
| WO | WO-10138831 | A2 | 12/2010 |

(56) References Cited

FOREIGN PATENT DOCUMENTS

| | | | |
|---|---|---|---|
| WO | WO-11069170 | A1 | 6/2011 |
| WO | WO-12092625 | A2 | 7/2012 |
| WO | WO-2012118550 | A1 | 9/2012 |

OTHER PUBLICATIONS

"Air Conditioning Equipment and Diagnostic Primer," Field Diagnostic Services, Inc., Sep. 9, 2002.
"Manual for Freezing and Air Conditioning Technology," Fan Jili, Liaoning Science and Technology Press, Sep. 1995 (cited in First Office Action issued by the Chinese Patent Office regarding Application No. 200780030810.X dated Dec. 25, 2009).
"Product Performance Introduction of York Company," cited in First Office Action from the Patent Office of the People's Republic of China dated Jun. 29, 2007 regarding Application No. 200510005907.8, including translation by CCPIT Patent and Trademark Law Office.
"Small-type Freezing and Air Conditioning Operation," Chinese State Economy and Trading Committee, China Meteorological Press, Mar. 2003 (cited in First Office Action issued by the Chinese Patent Office regarding Application No. 200780030810.X dated Dec. 25, 2009).
About CABA: CABA eBulletin, http://www.caba.org/aboutus/ebulletin/issue17/domosys.html, 2 pages, dated Sep. 22, 2004.
Advanced Utility Metering: Period of Performance, Subcontractor Report, National Renewable Energy Laboratory, Sep. 2003, 59 pages.
Advisory Action and Examiner-Initiated Interview Summary regarding U.S. Appl. No. 13/770,479, dated May 23, 2017.
Advisory Action and Interview Summary regarding U.S. Appl. No. 13/407,180, dated May 27, 2015.
Advisory Action Before the Filing of an Appeal Brief regarding U.S. Appl. No. 11/098,575, dated Nov. 16, 2009.
Advisory Action Before the Filing of an Appeal Brief regarding U.S. Appl. No. 11/098,575, dated Sep. 28, 2009.
Advisory Action Before the Filing of an Appeal Brief regarding U.S. Appl. No. 09/977,552, dated Nov. 10, 2005.
Advisory Action from related U.S. Appl. No. 13/784,890 dated Mar. 14, 2014.
Advisory Action regarding U.S. Appl. No. 12/261,643, dated Nov. 22, 2013.
Advisory Action regarding U.S. Appl. No. 13/269,188, dated Apr. 13, 2015.
Advisory Action regarding U.S. Appl. No. 14/080,473, dated Jan. 30, 2017.
Advisory Action regarding U.S. Appl. No. 14/193,568, dated Aug. 10, 2016.
Advisory Action regarding U.S. Appl. No. 14/208,636, dated Mar. 23, 2017.
Advisory Action regarding U.S. Appl. No. 14/212,632, dated Feb. 9, 2016.
Advisory Action regarding U.S. Appl. No. 14/212,632, dated Mar. 8, 2016.
Advisory Action regarding U.S. Appl. No. 11/214,179, dated Aug. 28, 2009.
Applicant-Initiated Interview Summary and Advisory Action regarding U.S. Appl. No. 13/369,067, dated Jul. 23, 2015.
Applicant-Initiated Interview Summary regarding U.S. Appl. No. 13/770,479, dated Dec. 9, 2016.
Applicant-Initiated Interview Summary regarding U.S. Appl. No. 14/212,632, dated Sep. 2, 2015.
BChydro, "Power Factor" Guides to Energy Management: The GEM Series, Oct. 1999.
Building Control Unit (BCU) Installation and Operation Manual, Computer Process Controls, Jan. 28, 1998, 141 pages.
Case Studies: Automated Meter Reading and Load Shed System, http://groupalpha.com/CaseStudies2.html, Aug. 23, 2004, 1 page.
Communication from European Patent Office concerning Substantive Examination regarding European Patent Application No. 06790063.9, dated Jun. 6, 2011.
Corrected Notice of Allowability regarding U.S. Appl. No. 14/080,473 dated Dec. 27, 2017.
Cost Cutting Techniques Used by the Unscrupulous, http://www.kellyshvac.com/howto.html, Oct. 7, 2004, 3 pages.
Einstein RX-300 Refrigeration Controller Installation and Operation Manual, Computer Process Controls, Apr. 1, 1998, 329 pages.
Election/Restriction Requirement regarding U.S. Appl. No. 09/977,552, dated Jan. 25, 2007.
European Search Report for Application No. EP 01 30 1752, dated Mar. 26, 2002.
European Search Report for Application No. EP 02 25 1531, dated Sep. 30, 2002.
European Search Report for Application No. EP 04 81 5853, dated Jul. 17, 2007, 2 Pages.
European Search Report for Application No. EP 06 02 6263, dated Jul. 17, 2007, 4 Pages.
European Search Report for Application No. EP 12 182 243.1, dated Oct. 29, 2012.
European Search Report for EP 01 30 7547; dated Feb. 20, 2002; 1 Page.
European Search Report for EP 02 25 0266; dated May 17, 2002; 3 Pages.
European Search Report for EP 02 72 9050, dated Jun. 17, 2004, 2 Pages.
European Search Report for EP 82306809.3; dated Apr. 28, 1983; 1 Page.
European Search Report for EP 91 30 3518; dated Jul. 22, 1991; 1 Page.
European Search Report for EP 93 30 4470; dated Oct. 26, 1993; 1 Page.
European Search Report for EP 94 30 3484; dated Apr. 3, 1997; 1 Page.
European Search Report for EP 96 30 4219; dated Dec. 1, 1998; 2 Pages.
European Search Report for EP 98 30 3525; dated May 28, 1999; 2 Pages.
European Search Report for EP 99 30 6052; dated Dec. 28, 1999; 3 Pages.
European Search Report regarding Application No. 04022784.5-2315 / 1500821, dated Aug. 14, 2012.
European Search Report regarding Application No. 07811712.4-1608 / 2069638 PCT/US2007019563, dated Jan. 7, 2014.
European Search Report regarding Application No. EP02729051, dated Feb. 17, 2005.
Examination Report received from Australian Government IP Australia dated Oct. 29, 2009 regarding Patent Application No. 2008202088.
Examiner Interview regarding U.S. Appl. No. 11/256,641, dated Sep. 16, 2008.
Examiner Interview Summary regarding U.S. Appl. No. 11/394,380, dated Jul. 29, 2010.
Examiner Interview Summary regarding U.S. Appl. No. 10/940,877, dated Dec. 8, 2008.
Examiner Interview Summary regarding U.S. Appl. No. 10/940,877, dated Mar. 2, 2007.
Examiner Interview Summary regarding U.S. Appl. No. 10/940,877, dated Mar. 25, 2008.
Examiner's Answer from related U.S. Appl. No. 13/784,890 dated Jul. 3, 2014.
Examiner's Answer regarding U.S. Appl. No. 09/977,552, dated Dec. 17, 2009.
Examiner's Answer regarding U.S. Appl. No. 12/943,626, dated Sep. 19, 2017.
Examiner's First Report on Australian Patent Application No. 2002259066, dated Mar. 1, 2006.
Examiner's First Report on Australian Patent Application No. 2007292917 dated Jan. 10, 2012.
Examiner's Report No. 1 regarding Australian Patent Application No. 2013202431, dated Nov. 25, 2014.
Examiner's Report No. 2 regarding Australian Patent Application No. 2008325240, dated Mar. 5, 2012.

(56) References Cited

OTHER PUBLICATIONS

Examiner-Initiated Interview Summary regarding U.S. Appl. No. 11/214,179, dated Dec. 11, 2009.
Extended European Search Report regarding Application No. 07796879.0-1602 / 2041501 PCT/US2007016135, dated Jul. 14, 2014.
Extended European Search Report regarding Application No. 12182243.1-2311, dated Oct. 29, 2012.
Extended European Search Report regarding European Application No. 08845689.2-1608/2207964, dated Jun. 19, 2015.
Extended European Search Report regarding European Application No. 08848538.8-1608 / 2220372, dated Jun. 19, 2015.
Faramarzi et al., "Performance Evaluation of Rooftop Air Conditioning Units at High Ambient Temperatures," 2004 ACEEE Summer Study on Energy Efficiency in Buildings—http://aceee.org/files/proceedings/2004/data/papers/SSO4_Panel3_Paper05.pdf.
Final Office Action and Interview Summary regarding U.S. Appl. No. 13/407,180, dated Mar. 13, 2015.
Final Office Action for U.S. Appl. No. 13/770,123 dated Dec. 22, 2014.
Final Office Action for U.S. Appl. No. 11/850,846, dated Aug. 13, 2012.
Final Office Action for U.S. Appl. No. 12/054,011, dated Jun. 30, 2011.
Final Office Action from related U.S. Appl. No. 13/269,188 dated May 23, 2013; 11 pages.
Final Office Action from related U.S. Appl. No. 13/369,067 dated May 1, 2014; 19 pages.
Final Office Action from related U.S. Appl. No. 13/767,479 dated Mar. 14, 2014; 6 pages.
Final Office Action from related U.S. Appl. No. 13/836,043 dated Mar. 12, 2014; 5 pages.
Final Office Action dated Dec. 7, 2010 for U.S. Appl. No. 12/054,011.
Final Office Action regarding U.S. Appl. No. 11/497,579, dated May 14, 2010.
Final Office Action regarding U.S. Appl. No. 11/497,644, dated Dec. 22, 2010.
Final Office Action regarding U.S. Appl. No. 11/850,846, dated Jan. 17, 2014.
Final Office Action regarding U.S. Appl. No. 13/269,188, dated Feb. 10, 2015.
Final Office Action regarding U.S. Appl. No. 13/767,479, dated Feb. 6, 2015.
Final Office Action regarding U.S. Appl. No. 13/770,123, dated Nov. 15, 2013.
Final Office Action regarding U.S. Appl. No. 13/784,890, dated Dec. 30, 2013.
Final Office Action regarding U.S. Appl. No. 13/932,611, dated May 28, 2014.
Final Office Action regarding U.S. Appl. No. 14/244,967, dated Feb. 12, 2016.
Final Office Action regarding U.S. Appl. No. 13/770,479, dated Sep. 4, 2015.
Final Office Action regarding U.S. Appl. No. 15/583,942 dated Apr. 18, 2018.
Final Office Action regarding U.S. Appl. No. 11/214,179, dated Jul. 21, 2011.
Final Office Action regarding U.S. Appl. No. 09/977,552, dated Oct. 22, 2008.
Final Office Action regarding U.S. Appl. No. 09/977,552, dated Apr. 26, 2004.
Final Office Action regarding U.S. Appl. No. 09/977,552, dated May 13, 2005.
Final Office Action regarding U.S. Appl. No. 09/977,552, dated Jun. 18, 2003.
Final Office Action regarding U.S. Appl. No. 09/977,552, dated Jul. 23, 2007.
Final Office Action regarding U.S. Appl. No. 10/061,964, dated Mar. 8, 2004.
Final Office Action regarding U.S. Appl. No. 10/940,877, dated Nov. 13, 2007.
Final Office Action regarding U.S. Appl. No. 10/940,877, dated Apr. 27, 2009.
Final Office Action regarding U.S. Appl. No. 10/940,877, dated May 2, 2006.
Final Office Action regarding U.S. Appl. No. 11/098,575, dated Jun. 17, 2010.
Final Office Action regarding U.S. Appl. No. 11/214,179, dated May 29, 2009.
Final Office Action regarding U.S. Appl. No. 11/256,641, dated Feb. 2, 2009.
Final Office Action regarding U.S. Appl. No. 11/337,918, dated Feb. 17, 2011.
Final Office action regarding U.S. Appl. No. 11/337,918, dated Feb. 4, 2010.
Final Office Action regarding U.S. Appl. No. 12/261,643, dated Jun. 27, 2012.
Final Office Action regarding U.S. Appl. No. 12/261,643, dated Sep. 16, 2013.
Final Office Action regarding U.S. Appl. No. 12/261,643, dated Jul. 7, 2011.
First Chinese Office Action regarding Application No. 201380005300.2, dated Apr. 30, 2015. Translation provided by Unitalen Attorneys at Law.
First Examination Communication regarding European Application No. EP02729051.9, dated Dec. 23, 2005.
First Examination Report regarding Australian Patent Application No. 2010319488, dated Jan. 10, 2013.
First Examination Report regarding Australian Patent Application No. 2012241185, dated Sep. 27, 2013.
First Office Action from the Patent Office of the People's Republic of China dated Jun. 8, 2007, Application No. 200480027753.6 and Translation provided by CCPIT.
First Office Action from the Patent Office of the People's Republic of China regarding Application No. 200510005907.8, dated Jun. 29, 2007.
First Office Action from the State Intellectual Property Office of the People's Republic of China regarding Chinese Patent Application No. 200890100287.3, dated Oct. 25, 2010. Translation provided by Unitalen Attorneys at Law.
First Office Action issued by the Chinese Patent Office for Application No. 200480015875.3, dated Sep. 5, 2008.
First Office Action issued by the Chinese Patent Office dated May 30, 2008 regarding Application No. 200580013451.8, 8 Pages. Translation provided by CCPIT Patent and Trademark Law Office.
First Office Action issued by the Chinese Patent Office regarding Application No. 200780030810.X dated Dec. 25, 2009.
First Office Action received from the Chinese Patent Office dated Feb. 2, 2007 regarding Application No. 200480011463.2, translated by CCPIT Patent and Trademark Law Office.
First Office Action regarding Canadian Patent Application No. 2,777,349, dated Jul. 19, 2013.
First Office Action regarding Chinese Application No. 200880106319.5, dated May 25, 2011. English translation provided by Unitalen Attorneys at Law.
First Office Action regarding Chinese Application No. 201610422700.4 dated Apr. 2, 2018. Translation provided by Unitalen Attorneys at Law.
First Office Action regarding Chinese Patent Application No. 200780032977.X, dated Sep. 27, 2010. English translation provided by Unitalen Attorneys at Law.
First Office Action regarding Chinese Patent Application No. 200910211779.0, dated May 3, 2012. English translation provided by Unitalen Attorneys at Law.
First Office Action regarding Chinese Patent Application No. 201110349785.X, dated Nov. 21, 2013, and Search Report. English translation provided by Unitalen Attorneys at Law.
First Office Action regarding Chinese Patent Application No. 201280010796.8, dated Sep. 14, 2015. Translation provided by Unitalen Attorneys at Law.
First Official Report regarding Australian Patent Application No. 2007214381, dated Dec. 12, 2008.

(56) References Cited

OTHER PUBLICATIONS

Flow & Level Measurement: Mass Flowmeters, http://www.omega.com/literature/transactions/volume4/T9904-10-MASS.html, 2001, 19 pages.
Fourth Office Action from the State Intellectual Property Office of People's Republic of China regarding Chinese Patent Application No. 200510005907.8, dated Dec. 8, 2011. Translation provided by Unitalen Attorneys at Law.
Fourth Office Action regarding Chinese Patent Application No. 200910211779.0, dated Jan. 6, 2014. English translation provided by Unitalen Attorneys at Law.
Frequently Asked Questions, http://www.lipaedge.com/faq.asp, Copyright © 2001, 5 pages.
Haiad et al., "EER & SEER as Predictors of Seasonal Energy Performance", Oct. 2004, Southern California Edison, http://www.doe2.com/download/DEER/SEER%2BProgThermostats/EER-SEER_CASE_ProjectSummary_Oct2004_V6a.pdf.
Home Comfort Zones, MyTemp Room-by-Room Zone Control, Nov. 2009.
Home Comfort Zones, MyTemp User Manual v4.3, May 2008.
Home Comfort Zones, Save Energy with MyTemp™ Zone Control, Dec. 2009.
Home Comfort Zones, Smart Controller™ MyTemp™ Room by Room Temperature Control and Energy Management, User Manual, Aug. 2007.
Honeywell, A7075A1000 HVAC Service Assistant, 2001.
Honeywell, Advanced Portable A/C Diagnostics, The HVAC Service Assistant, 2003.
Honeywell, Alerts and Delta T Diagnostics with Prestige® 2.0 IAQ Thermostat, 69-2678-02, Sep. 2011.
Honeywell, Excel 5000® System, Excel Building Supervisor—Integrated, 74-2034, Copyright © 1994, Rev. 11-94, 12 pages.
Honeywell, Excel 5000® System, Excel Building Supervisor, 74-2033-1, Copyright © 1996, Rev. Jun. 1996, 12 pages.
Honeywell, HVAC Service Assistant, TRGpro PalmTM OS Interface and HVAC Service Assistant A7075A1000, 2002.
Honeywell, Prestige System Installation Guide, THX9321/9421 Prestige® IAQ and RF EIM, 64-2490-03, Jul. 2011.
Honeywell, RedLINK™ Wireless Comfort Systems brochure, 50-1194, Sep. 2011.
HVAC Service Assistant, ACRx Efficiency and Capacity Estimating Technology, Field Diagnostics, 2004.
International Preliminary Examination Report regarding PCT/US02/13456, dated Sep. 15, 2003.
International Preliminary Report on Patentability for International Application No. PCT/US2008/009618, dated Mar. 24, 2010.
International Preliminary Report on Patentability for International Application No. PCT/US2008/012362, dated May 4, 2010.
International Preliminary Report on Patentability for International Application No. PCT/US2008/012364, dated May 4, 2010.
International Preliminary Report on Patentability regarding Application No. PCT/US2010/056315, dated May 24, 2012.
International Preliminary Report on Patentability regarding International Application No. PCT/US2007/019563 dated Mar. 10, 2009.
International Search Report and Written Opinion for related PCT Application No. PCT/US2014/028859, dated Aug. 22, 2014.
International Search Report and Written Opinion of the International Searching Authority regarding International Application No. PCT/US06/33702, dated Sep. 26, 2007.
International Search Report and Written Opinion of the ISA regarding International Application No. PCT/US2014/032927, ISA/KR dated Aug. 21, 2014.
International Search Report for International Application No. PCT/US04/43859, dated Mar. 2, 2006.
International Search Report for International Application No. PCT/US07/019563, dated Jan. 15, 2008, 3 Pages.
International Search Report for International Application No. PCT/US2007/016135 dated Oct. 22, 2007.
International Search Report for International Application No. PCT/US2008/009618, dated Dec. 8, 2008.
International Search Report for International Application No. PCT/US2008/012364 dated Mar. 13, 2009.
International Search Report for PCT/US02/13459; ISA/US; dated Sep. 19, 2002.
International Search Report for PCT/US2012/026973, dated Sep. 3, 2012, 5 pages.
International Search Report for PCT/US2013/061389, dated Jan. 22, 2014, 7 pages.
International Search Report from PCT/US2008/060900, dated Aug. 4, 2008, 6 pages.
International Search Report from related PCT Application No. PCT/US2014/028074 dated Jun. 19, 2014.
International Search Report regarding Application No. PCT/US2010/036601, dated Dec. 29, 2010.
International Search Report regarding Application No. PCT/US2010/056315, dated Jun. 28, 2011.
International Search Report regarding Application No. PCT/US2013/021161, dated May 8, 2013.
International Search Report, International App. No. PCT/US06/05917, dated Sep. 26, 2007.
International Search Report, International Application No. PCT/US02/13456, dated Aug. 22, 2002, 2 Pages.
International Search Report, International Application No. PCT/USO4/13384; dated Aug. 1, 2004; 1 Page.
International Search Report, International Application No. PCT/US2004/027654, dated Aug. 25, 2004, 4 Pages.
International Search Report, International Application No. PCT/US2006/040964, dated Feb. 15, 2007, 2 Pages.
International Search Report; International Application No. PCT/IB96/01435; dated May 23, 1997; 1 Page.
International Search Report; International Application No. PCT/US98/18710; dated Jan. 26, 1999; 1 Page.
Interview Summary regarding U.S. Appl. No. 12/054,011, dated Jan. 30, 2012.
Interview Summary regarding U.S. Appl. No. 11/497,644, dated May 4, 2010.
Interview Summary regarding U.S. Appl. No. 13/269,188, dated Mar. 18, 2015.
Interview Summary regarding U.S. Appl. No. 13/369,067, dated Jul. 16, 2015.
Interview Summary regarding U.S. Appl. No. 13/407,180, dated Jun. 11, 2015.
Interview Summary regarding U.S. Appl. No. 13/770,479, dated Jun. 16, 2015.
Interview Summary regarding U.S. Appl. No. 13/770,479, dated May 10, 2017.
Interview Summary regarding U.S. Appl. No. 13/770,479, dated Nov. 25, 2015.
Interview Summary regarding U.S. Appl. No. 14/209,415, dated Jun. 20, 2016.
Interview Summary regarding U.S. Appl. No. 14/617,451, dated Jul. 28, 2016.
Interview Summary regarding U.S. Appl. No. 11/098,582, dated Apr. 27, 2010.
Interview Summary regarding U.S. Appl. No. 11/214,179, dated Jan. 30, 2009.
Interview Summary regarding U.S. Appl. No. 11/497,579, dated Jul. 15, 2010.
Invitation to Indicate Claims to be Searched regarding European Patent Application No. 07 796 879.0, dated Feb. 20, 2013.
Issue Notification regarding U.S. Appl. No. 11/214,179, dated Mar. 14, 2012.
Jeffus, Larry, "Refrigeration and Air Conditioning: An Introduction to HVAC/R," Appendix C, pp. 1060-1063, Copyright 2004.
Jeffus, Larry, "Refrigeration and Air Conditioning: An Introduction to HVAC/R," Section II, Chapter 4, pp. 176-201, Copyright 2004.
Jeffus, Larry, "Refrigeration and Air Conditioning: An Introduction to HVAC/R," Section II, Chapter 5, pp. 239-245, Copyright 2004.
Jeffus, Larry, "Refrigeration and Air Conditioning: An Introduction to HVAC/R," Section II, Chapter 6, p. 322, Copyright 2004.
Jeffus, Larry, "Refrigeration and Air Conditioning: An Introduction to HVAC/R," Section IV, Chapter 9, pp. 494-504, Copyright 2004.

(56) References Cited

OTHER PUBLICATIONS

K. A. Manske et al.; Evaporative Condenser Control in Industrial Refrigeration Systems; University of Wisconsin—Madison, Mechanical Engineering Department; International Journal of Refrigeration, vol. 24, No. 7; pp. 676-691; 2001, 21 pages.
Kim, Minsung et al., "Performance of a Residential Heat Pump Operating in the Cooling Mode With Single Faults Imposed", Sep. 2006, U.S. Department of Commerce, NISTIR 7350 (175 pages).
Li et al., "Development, Evaluation, and Demonstration of a Virtual Refrigerant Charge Sensor," Jan. 2009, HVAC&R Research, Oct. 27, 2008, 21 pages.
Liao et al., A Correlation of Optimal Heat Rejection Pressures in Transcritical Carbon Dioxide Cycles, Applied Thermal Engineering 20 (2000), Jul. 25, 1999, 831-841.
LIPA Launches Free, First-in-Nation Internet-Based Air Conditioner Control Program to Help LIPA and Its Customers Conserve Electricity & Save Money, Apr. 19, 2001, http://www.lipower.org/newscmter/pr/2001/aprill9_0l.html, 3 pages.
Louis Goodman et al. "Vertical Motion of Neutrally Buoyant Floats." Journal of Atmospheric and Oceanic Technology. vol. 7. Feb. 1990.
Low-Cost Multi-Service Home Gateway Creates New Business Opportunities, Coactive Networks, Copyright 1998-1999, 7 pages.
Nickles, Donald, "Broadband Communications Over Power Transmission Lines," A Guest Lecture From the Dr. Shreekanth Mandaynam Engineering Frontiers Lecture Series, May 5, 2004, 21 pages.
Non Final Office Action from related U.S. Appl. No. 13/269,188 dated Aug. 14, 2012; 9 pages.
Non Final Office Action from related U.S. Appl. No. 13/269,188 dated Feb. 20, 2014; 9 pages.
Non Final Office Action from related U.S. Appl. No. 13/269,188 dated Jul. 17, 2014; 10 pages.
Non Final Office Action from related U.S. Appl. No. 13/369,067 dated Jan. 16, 2014; 16 pages.
Non Final Office Action from related U.S. Appl. No. 13/767,479 dated Oct. 24, 2013; 8 pages.
Non Final Office Action from related U.S. Appl. No. 13/767,479 dated Jul. 23, 2014; 9 pages.
Non Final Office Action from related U.S. Appl. No. 13/835,621 dated Oct. 30, 2013; 8 pages.
Non Final Office Action from related U.S. Appl. No. 13/835,621 dated Apr. 2, 2014; 11 pages.
Non Final Office Action from related U.S. Appl. No. 13/835,742 dated Oct. 7, 2013; 9 pages.
Non Final Office Action from related U.S. Appl. No. 13/835,810 dated Nov. 15, 2013; 9 pages.
Non Final Office Action from related U.S. Appl. No. 13/836,043 dated Oct. 23, 2013; 8 pages.
Non Final Office Action from related U.S. Appl. No. 13/836,043 dated Jul. 11, 2014; 5 pages.
Non Final Office Action from related U.S. Appl. No. 13/836,244 dated Oct. 15, 2013; 11 pages.
Non Final Office Action from related U.S. Appl. No. 13/836,244 dated Feb. 20, 2014; 10 pages.
Non Final Office Action from related U.S. Appl. No. 13/836,453 dated Aug. 20, 2013; 8 pages.
Non-Final Office Action for U.S. Appl. No. 11/098,575 dated Jan. 27, 2010.
Non-Final Office Action for U.S. Appl. No. 11/776,879, dated Mar. 16, 2012.
Non-Final Office Action for U.S. Appl. No. 12/054,011, dated Oct. 20, 2011.
Non-Final Office Action for U.S. Appl. No. 12/054,011, dated Apr. 10, 2012.
Non-Final Office Action for U.S. Appl. No. 12/685,375, dated Aug. 6, 2012.
Non-Final Office Action for U.S. Appl. No. 13/030,549, dated Nov. 5, 2012.
Non-Final Office Action in U.S. Appl. No. 11/850,846, dated May 24, 2013.
Non-Final Office Action in U.S. Appl. No. 12/685,375, dated Jan. 19, 2012.
Non-Final Office Action dated Mar. 3, 2011 for U.S. Appl. No. 12/054,011.
Non-Final Office Action dated Aug. 13, 2010 for U.S. Appl. No. 12/054,011.
Non-Final Office Action regarding U.S. Appl. No. 13/770,479, dated Mar. 16, 2015.
Non-Final Office Action regarding U.S. Appl. No. 13/269,188, dated Oct. 4, 2013.
Non-Final Office Action regarding U.S. Appl. No. 13/269,188, dated Oct. 6, 2014.
Non-Final Office Action regarding U.S. Appl. No. 13/369,067, dated Aug. 12, 2014.
Non-Final Office Action regarding U.S. Appl. No. 13/407,180, dated Dec. 2, 2014.
Non-Final Office Action regarding U.S. Appl. No. 13/770,123, dated Jul. 3, 2013.
Non-Final Office Action regarding U.S. Appl. No. 13/770,479, dated Jan. 16, 2014.
Non-Final Office Action regarding U.S. Appl. No. 13/770,479, dated Sep. 7, 2016.
Non-Final Office Action regarding U.S. Appl. No. 13/784,890, dated Jun. 11, 2013.
Non-Final Office Action regarding U.S. Appl. No. 13/835,621, dated Aug. 8, 2014.
Non-Final Office Action regarding U.S. Appl. No. 13/932,611, dated Nov. 25, 2013.
Non-Final Office Action regarding U.S. Appl. No. 14/949,090 dated Jul. 5, 2018.
Non-Final Office Action regarding U.S. Appl. No. 15/096,186, dated Sep. 20, 2018.
Non-Final Office Action regarding U.S. Appl. No. 15/613,375 dated Aug. 30, 2018.
Non-Final Office Action regarding U.S. Appl. No. 11/214,179, dated Jan. 24, 2011.
Non-Final Office Action regarding U.S. Appl. No. 11/214,179, dated Nov. 5, 2008.
Non-Final Office Action regarding U.S. Appl. No. 11/214,179, dated Jun. 8, 2010.
Non-Final Office Action regarding U.S. Appl. No. 12/261,643, dated Jan. 27, 2011.
Non-Final Office Action regarding U.S. Appl. No. 12/261,643, dated Mar. 12, 2013.
Non-Final Office Action regarding U.S. Appl. No. 12/943,626, dated Dec. 20, 2012.
Non-Final Office Action regarding U.S. Appl. No. 12/955,355, dated Sep. 11, 2012.
Non-Final Office Action regarding U.S. Appl. No. 13/176,021, dated May 8, 2012.
Non-Final Office Action regarding U.S. Appl. No. 13/435,543, dated Jun. 21, 2012.
Non-Final Office Action regarding U.S. Appl. No. 13/770,123, dated Jun. 11, 2014.
Non-Final Office Action regarding U.S. Appl. No. 13/932,611, dated Jan. 30, 2015.
Notice of Allowance and Fee(s) Due regarding U.S. Appl. No. 12/789,562, dated Oct. 26, 2012.
Notice of Allowance and Fees Due and Notice of Allowability regarding U.S. Appl. No. 11/098,582, dated Feb. 24, 2009.
Notice of Allowance and Fees Due and Notice of Allowability regarding U.S. Appl. No. 11/098,582, dated Sep. 24, 2010.
Notice of Allowance and Fees Due and Notice of Allowability regarding U.S. Appl. No. 11/256,641, dated May 19, 2009.
Notice of Allowance and Fees Due regarding U.S. Appl. No. 12/261,643, dated Jun. 23, 2014.
Notice of Allowance and Fees Due regarding U.S. Appl. No. 12/943,626, dated Jun. 19, 2014.
Notice of Allowance and Fees Due regarding U.S. Appl. No. 13/737,566, dated Jun. 18, 2014.
Notice of Allowance and Fees Due regarding U.S. Appl. No. 13/737,566, dated Sep. 24, 2014.

(56) References Cited

OTHER PUBLICATIONS

Notice of Allowance and Fees Due, Interview Summary and Notice of Allowability regarding U.S. Appl. No. 11/214,179, dated Nov. 23, 2011.
Notice of Allowance and Interview Summary regarding U.S. Appl. No. 13/269,188, dated Aug. 26, 2015.
Notice of Allowance and Notice of Allowability regarding U.S. Appl. No. 10/286,419, dated Dec. 2, 2004.
Notice of Allowance dated Dec. 21, 2007 from Related U.S. Appl. No. 11/417,609.
Notice of Allowance dated Dec. 3, 2007 from Related U.S. Appl. No. 11/130,562.
Notice of Allowance dated Feb. 12, 2007 from Related U.S. Appl. No. 11/130,871.
Notice of Allowance dated Jul. 13, 2006 from Related U.S. Appl. No. 11/130,601.
Notice of Allowance dated Jul. 25, 2007 from Related U.S. Appl. No. 10/916,223.
Notice of Allowance dated Jun. 11, 2007 from Related U.S. Appl. No. 10/916,222.
Notice of Allowance dated May 29, 2007 from Related U.S. Appl. No. 11/130,569.
Notice of Allowance dated Nov. 3, 2008 from Related U.S. Appl. No. 11/417,701.
Notice of Allowance dated Oct. 26, 2007 from Related U.S. Appl. No. 10/916,223.
Notice of Allowance for U.S. Appl. No. 13/835,742 dated Dec. 24, 2014.
Notice of Allowance for U.S. Appl. No. 13/835,810 dated Jan. 2, 2015.
Notice of Allowance for related U.S. Appl. No. 13/835,810 dated Aug. 5, 2014.
Notice of Allowance for related U.S. Appl. No. 13/836,244, dated Oct. 30, 2014.
Notice of Allowance for U.S. Appl. No. 10/698,048, dated Sep. 1, 2005.
Notice of Allowance from related U.S. Appl. No. 13/835,810 dated Mar. 20, 2014; 9 pages.
Notice of Allowance from related U.S. Appl. No. 13/836,244 dated Jul. 2, 2014; 8 pages.
Notice of Allowance regarding U.S. Appl. No. 13/767,479, dated Mar. 31, 2015.
Notice of Allowance regarding U.S. Appl. No. 13/770,123, dated Oct. 1, 2015.
Notice of Allowance regarding U.S. Appl. No. 13/835,621, dated Mar. 10, 2015.
Notice of Allowance regarding U.S. Appl. No. 13/835,742, dated Jan. 31, 2014.
Notice of Allowance regarding U.S. Appl. No. 13/835,742, dated Jun. 2, 2014.
Notice of Allowance regarding U.S. Appl. No. 13/835,742, dated Apr. 17, 2015.
Notice of Allowance regarding U.S. Appl. No. 13/836,043, dated Feb. 4, 2015.
Notice of Allowance regarding U.S. Appl. No. 13/836,043, dated Oct. 9, 2014.
Notice of Allowance regarding U.S. Appl. No. 13/836,453, dated Apr. 21, 2014.
Notice of Allowance regarding U.S. Appl. No. 13/836,453, dated Aug. 4, 2014.
Notice of Allowance regarding U.S. Appl. No. 13/836,453, dated Dec. 24, 2014.
Notice of Allowance regarding U.S. Appl. No. 13/836,453, dated Jan. 14, 2014.
Notice of Allowance regarding U.S. Appl. No. 12/261,643, dated Jul. 29, 2015.
Notice of Allowance regarding U.S. Appl. No. 13/369,067, dated Sep. 2, 2015.
Notice of Allowance regarding U.S. Appl. No. 13/407,180, dated Sep. 4, 2015.
Notice of Allowance regarding U.S. Appl. No. 13/770,123, dated Aug. 13, 2015.
Notice of Allowance regarding U.S. Appl. No. 13/836,453, dated Apr. 15, 2015.
Notice of Allowance regarding U.S. Appl. No. 13/932,611, dated Jul. 6, 2015.
Notice of Allowance regarding U.S. Appl. No. 14/208,636 dated Jul. 30, 2018.
Notice of Allowance regarding U.S. Appl. No. 14/208,636 dated Sep. 25, 2018.
Notice of Allowance regarding U.S. Appl. No. 14/607,782 dated Jul. 3, 2018.
Notice of Allowance regarding U.S. Appl. No. 14/607,782 dated May 21, 2018.
Notice of Allowance regarding U.S. Appl. No. 15/583,942 dated Aug. 7, 2018.
Notice of Allowance regarding U.S. Appl. No. 15/645,970 dated Jun. 29, 2018.
Notice of Allowance regarding U.S. Appl. No. 15/645,970 dated Oct. 31, 2018.
Notice of Allowance regarding U.S. Appl. No. 10/061,964, dated Jul. 19, 2004.
Notice of Allowance regarding U.S. Appl. No. 10/940,877, dated Sep. 4, 2009.
Notice of Allowance regarding U.S. Appl. No. 11/776,879, dated Jul. 9, 2012.
Notice of Allowance regarding U.S. Appl. No. 12/261,677, dated Dec. 15, 2011.
Notice of Allowance regarding U.S. Appl. No. 13/303,286, dated Jul. 19, 2012.
Notice of Grounds for Refusal regarding Korean Patent Application No. 10-2009-7000850, dated Oct. 4, 2013. English translation provided by Y.S. Chang & Associates.
Notice of Panel Decision from Pre-Appeal Brief Review regarding U.S. Appl. No. 09/977,552, dated Aug. 4, 2009.
Notification of First Office Action from the State Intellectual Property Office of People's Republic of China regarding Chinese Patent Application No. 200880122964.6, dated Nov. 5, 2012. Translation provided by Unitalen Attorneys at Law.
Office Action and Interview Summary regarding U.S. Appl. No. 14/244,967, dated Oct. 7, 2015.
Office Action Communication regarding U.S. Appl. No. 09/977,552, dated Apr. 18, 2007.
Office Action dated Apr. 19, 2006 from Related U.S. Appl. No. 10/916,223.
Office Action dated Aug. 17, 2007 from Related U.S. Appl. No. 11/417,609.
Office Action dated Aug. 17, 2007 from Related U.S. Appl. No. 11/417,701.
Office Action dated Aug. 21, 2007 from Related U.S. Appl. No. 11/417,557.
Office Action dated Feb. 1, 2007 from Related U.S. Appl. No. 11/130,562.
Office Action dated Feb. 13, 2009 from Related U.S. Appl. No. 12/033,765.
Office Action dated Feb. 13, 2009 from Related U.S. Appl. No. 12/050,821.
Office Action dated Feb. 15, 2008 from Related U.S. Appl. No. 11/417,557.
Office Action dated Feb. 3, 2009 from Related U.S. Appl. No. 11/866,295.
Office Action dated Jan. 18, 2006 from Related U.S. Appl. No. 11/130,601.
Office Action dated Jan. 18, 2006 from Related U.S. Appl. No. 11/130,871.
Office Action dated Jan. 23, 2007 from Related U.S. Appl. No. 10/916,222.
Office Action dated Jan. 6, 2006 from Related U.S. Appl. No. 11/130,562.
Office Action dated Jan. 6, 2006 from Related U.S. Appl. No. 10/916,222.
Office Action dated Jul. 1, 2008 from Related U.S. Appl. No. 11/927,425.

(56) References Cited

OTHER PUBLICATIONS

Office Action dated Jul. 11, 2006 from Related U.S. Appl. No. 11/130,562.
Office Action dated Jul. 11, 2006 from Related U.S. Appl. No. 10/916,222.
Office Action dated Jul. 11, 2007 from Related U.S. Appl. No. 11/417,609.
Office Action dated Jul. 11, 2007 from Related U.S. Appl. No. 11/417,701.
Office Action dated Jul. 16, 2008 from Related U.S. Appl. No. 11/417,701.
Office Action dated Jul. 24, 2008 from Related U.S. Appl. No. 11/417,557.
Office Action dated Jul. 27, 2006 from Related U.S. Appl. No. 11/130,871.
Office Action dated Jun. 17, 2009 from Related U.S. Appl. No. 12/033,765.
Office Action dated Jun. 19, 2009 from Related U.S. Appl. No. 11/866,295.
Office Action dated Jun. 22, 2009 from Related U.S. Appl. No. 12/050,821.
Office Action dated Jun. 27, 2007 from Related U.S. Appl. No. 11/417,557.
Office Action dated Mar. 30, 2006 from Related U.S. Appl. No. 11/130,569.
Office Action dated May 4, 2005 from Related U.S. Appl. No. 10/916,223.
Office Action dated May 6, 2009 from Related U.S. Appl. No. 11/830,729.
Office Action dated Nov. 14, 2006 from Related U.S. Appl. No. 11/130,569.
Office Action dated Nov. 16, 2006 from Related U.S. Appl. No. 10/916,223.
Office Action dated Nov. 8, 2005 from Related U.S. Appl. No. 10/916,222.
Office Action dated Nov. 9, 2005 from Related U.S. Appl. No. 11/130,562.
Office Action dated Nov. 9, 2005 from Related U.S. Appl. No. 11/130,601.
Office Action dated Nov. 9, 2005 from Related U.S. Appl. No. 11/130,871.
Office Action dated Oct. 27, 2005 from Related U.S. Appl. No. 10/916,223.
Office Action dated Sep. 18, 2007 from Related U.S. Appl. No. 11/130,562.
Office Action for U.S. Appl. No. 13/835,621 dated Dec. 29, 2014.
Office Action for Canadian Application No. 2,828,740 dated Jan. 12, 2015.
Office Action for related U.S. Appl. No. 13/767,479, dated Oct. 21, 2014.
Office Action for U.S. Appl. No. 11/394,380, dated Jan. 6, 2009.
Office Action for U.S. Appl. No. 11/497,579, dated Oct. 27, 2009.
Office Action for U.S. Appl. No. 11/497,644, dated Dec. 19, 2008.
Office Action for U.S. Appl. No. 11/497,644, dated Jul. 10, 2009.
Office Action from U.S. Appl. No. 13/369,067 dated Apr. 3, 2015.
Office Action regarding U.S. Appl. No. 13/770,123, dated Apr. 2, 2015.
Office Action regarding Australian Patent Application No. 2013323760, dated Sep. 25, 2015.
Office Action regarding Australian Patent Application No. 2014229103, dated Apr. 28, 2016.
Office Action regarding Australian Patent Application No. 2014248049, dated Oct. 10, 2017.
Office Action regarding Australian Patent Application No. 2015207920, dated Dec. 4, 2015.
Office Action regarding Australian Patent Application No. 2015255255, dated Sep. 8, 2016.
Office Action regarding Canadian Patent Application No. 2,904,734, dated Sep. 13, 2016.
Office Action regarding Canadian Patent Application No. 2,908,362, dated Sep. 21, 2016.
Office Action regarding Canadian Patent Application No. 2,934,860, dated May 4, 2017.
Office Action regarding Chinese Patent Application No. 201380005300.2, dated Jan. 4, 2016. Translation provided by Unitalen Attorneys at Law.
Office Action regarding Chinese Patent Application No. 201380049458.X, dated Nov. 13, 2015. Translation provided by Unitalen Attorneys at Law.
Office Action regarding Chinese Patent Application No. 201480016023.X, dated Jun. 22, 2016. Translation provided by Unitalen Attorneys at Law.
Office Action regarding Chinese Patent Application No. 201480016177.9, dated Apr. 7, 2017. Translation provided by Unitalen Attorneys at Law.
Office Action regarding Chinese Patent Application No. 201480025776.7, dated Jan. 10, 2018. Translation provided by Unitalen Attorneys at Law.
Office Action regarding European Patent Application No. 07796879.0, dated Oct. 19, 2017.
Office Action regarding European Patent Application No. 07811712.4, dated Jul. 25, 2017.
Office Action regarding European Patent Application No. 08848538.8, dated Feb. 3, 2016.
Office Action regarding Indian Patent Application No. 102/KOLNP/2009, dated Mar. 10, 2017.
Office Action regarding Indian Patent Application No. 456/MUMNP/2010, dated Oct. 3, 2017.
Office Action regarding Indian Patent Application No. 733/KOLNP/2009, dated Aug. 12, 2015.
Office Action regarding U.S. Appl. No. 10/286,419, dated Jun. 10, 2004.
Office Action regarding U.S. Appl. No. 11/098,575, dated Jan. 29, 2009.
Office Action regarding U.S. Appl. No. 11/098,575, dated Mar. 26, 2008.
Office Action regarding U.S. Appl. No. 11/098,575, dated Jul. 13, 2009.
Office Action regarding U.S. Appl. No. 11/098,575, dated Sep. 9, 2008.
Office Action regarding U.S. Appl. No. 11/120,166, dated Oct. 2, 2006.
Office Action regarding U.S. Appl. No. 11/120,166, dated Oct. 2, 2007.
Office Action regarding U.S. Appl. No. 11/120,166, dated Dec. 15, 2008.
Office Action regarding U.S. Appl. No. 11/120,166, dated Feb. 17, 2010.
Office Action regarding U.S. Appl. No. 11/120,166, dated Apr. 12, 2007.
Office Action regarding U.S. Appl. No. 11/120,166, dated Jun. 5, 2008.
Office Action regarding U.S. Appl. No. 11/120,166, dated Jul. 20, 2009.
Office Action regarding U.S. Appl. No. 11/394,380, dated Sep. 25, 2009.
Office Action regarding U.S. Appl. No. 11/497,644, dated Jan. 29, 2010.
Office Action regarding U.S. Appl. No. 11/497,644, dated Jun. 14, 2010.
Office Action regarding U.S. Appl. No. 12/943,626, dated May 4, 2016.
Office Action regarding U.S. Appl. No. 12/943,626, dated Nov. 4, 2016.
Office Action regarding U.S. Appl. No. 13/770,479, dated Mar. 17, 2017.
Office Action regarding U.S. Appl. No. 14/080,473, dated Jun. 6, 2016.
Office Action regarding U.S. Appl. No. 14/080,473, dated Mar. 14, 2017.
Office Action regarding U.S. Appl. No. 14/080,473, dated Nov. 16, 2016.

(56) References Cited

OTHER PUBLICATIONS

Office Action regarding U.S. Appl. No. 14/193,568, dated Jun. 1, 2016.
Office Action regarding U.S. Appl. No. 14/193,568, dated Nov. 3, 2015.
Office Action regarding U.S. Appl. No. 14/208,636 dated Jan. 3, 2018.
Office Action regarding U.S. Appl. No. 14/208,636, dated Aug. 4, 2016.
Office Action regarding U.S. Appl. No. 14/208,636, dated Jan. 26, 2017.
Office Action regarding U.S. Appl. No. 14/209,415, dated Mar. 10, 2016.
Office Action regarding U.S. Appl. No. 14/209,415, dated Sep. 10, 2015.
Office Action regarding U.S. Appl. No. 14/212,632, dated Apr. 7, 2016.
Office Action regarding U.S. Appl. No. 14/212,632, dated Nov. 19, 2015.
Office Action regarding U.S. Appl. No. 14/244,967, dated Aug. 29, 2016.
Office Action regarding U.S. Appl. No. 14/244,967, dated Jan. 20, 2017.
Office Action regarding U.S. Appl. No. 14/255,519, dated Nov. 9, 2015.
Office Action regarding U.S. Appl. No. 14/255,519, dated Oct. 5, 2016.
Office Action regarding U.S. Appl. No. 14/300,782, dated Sep. 30, 2016.
Office Action regarding U.S. Appl. No. 14/607,782, dated Sep. 21, 2017.
Office Action regarding U.S. Appl. No. 14/617,451, dated Jun. 2, 2016.
Office Action regarding U.S. Appl. No. 14/727,756, dated Aug. 22, 2016.
Office Action regarding U.S. Appl. No. 15/096,196, dated Sep. 13, 2016.
Office Action regarding U.S. Appl. No. 15/645,970 dated Feb. 16, 2018.
Office Action regarding U.S. Appl. No. 09/977,552, dated Jan. 11, 2008.
Office Action regarding U.S. Appl. No. 09/977,552, dated Jan. 14, 2003.
Office Action regarding U.S. Appl. No. 09/977,552, dated Oct. 18, 2004.
Office Action regarding U.S. Appl. No. 09/977,552, dated Dec. 3, 2003.
Office Action regarding U.S. Appl. No. 09/977,552, dated Jul. 12, 2006.
Office Action regarding U.S. Appl. No. 10/061,964, dated Oct. 3, 2003.
Office Action regarding U.S. Appl. No. 10/675,137, dated Sep. 7, 2004.
Office Action regarding U.S. Appl. No. 10/698,048, dated Mar. 21, 2005.
Office Action regarding U.S. Appl. No. 10/940,877, dated Oct. 27, 2006.
Office Action regarding U.S. Appl. No. 10/940,877, dated Nov. 14, 2005.
Office Action regarding U.S. Appl. No. 10/940,877, dated Dec. 8, 2008.
Office Action regarding U.S. Appl. No. 10/940,877, dated May 21, 2007.
Office Action regarding U.S. Appl. No. 10/940,877, dated Jun. 5, 2008.
Office Action regarding U.S. Appl. No. 11/098,582, dated Mar. 3, 2010.
Office Action regarding U.S. Appl. No. 11/098,582, dated Jul. 7, 2008.
Office Action regarding U.S. Appl. No. 11/098,582, dated Aug. 4, 2009.
Office Action regarding U.S. Appl. No. 11/098,582, dated Sep. 21, 2007.
Office Action regarding U.S. Appl. No. 11/256,641, dated Apr. 29, 2008.
Office Action regarding U.S. Appl. No. 11/337,918, dated Mar. 25, 2008.
Office Action regarding U.S. Appl. No. 11/337,918, dated Aug. 17, 2009.
Office Action regarding U.S. Appl. No. 11/337,918, dated Oct. 28, 2008.
Office Action regarding U.S. Appl. No. 11/776,879, dated Sep. 17, 2010.
Office Action regarding U.S. Appl. No. 11/850,846, dated Aug. 13, 2010.
Office Action regarding U.S. Appl. No. 12/261,643, dated Nov. 2, 2011.
Office Action regarding U.S. Appl. No. 12/261,643, dated Feb. 15, 2012.
Office Action regarding U.S. Appl. No. 12/261,677, dated Aug. 4, 2011.
Office Action regarding U.S. Appl. No. 13/303,286, dated Mar. 26, 2012.
Office Action regarding U.S. Appl. No. 13/737,566, dated Dec. 20, 2013.
Official Action regarding Australian Patent Application No. 2008325240, dated Jan. 19, 2011.
Palani, M. et al, Monitoring the Performance of a Residential Central Air Conditioner under Degraded Conditions on a Test Bench, ESL-TR-92/05-05, May 1992.
Palani, M. et al, The Effect of Reducted Evaporator Air Flow on the Performance of a Residential Central Air Conditioner, ESL-HH-92-05-04, Energy Systems Laboratory, Mechanical Engineering Department, Texas A&M University, Eighth Symposium on Improving Building System in Hot and Humid Climates, May 13-14, 1992.
Patent Examination Report for Australian Application No. 2012223466 dated Jan. 6, 2015.
Patent Examination Report No. 3 regarding Australian Patent Application No. 2008325240, dated Jul. 19, 2012.
Pin, C. et al., "Predictive Models as Means to Quantify the Interactions of Spoilage Organisms," International Journal of Food Microbiology, vol. 41, No. 1, 1998, pp. 59-72, XP-002285119.
Record of Oral Hearing regarding U.S. Appl. No. 09/977,552, dated Nov. 29, 2012.
Reh, F. John, "Cost Benefit Analysis", http://management.about.com/cs/money/a/CostBenefit.htm, Dec. 8, 2003.
Response to Rule 312 Communication regarding U.S. Appl. No. 09/977,552, dated Oct. 31, 2003.
Restriction Requirement regarding U.S. Appl. No. 11/776,879, dated Jun. 4, 2010.
Restriction Requirement regarding U.S. Appl. No. 13/269,188, dated Apr. 9, 2013.
Restriction Requirement regarding U.S. Appl. No. 14/244,967, dated Jul. 14, 2015.
Restriction Requirement regarding U.S. Appl. No. 14/607,782, dated Jun. 29, 2017.
Restriction Requirement regarding U.S. Appl. No. 10/940,877, dated Jul. 25, 2005.
Restriction Requirement regarding U.S. Appl. No. 11/214,179, dated Feb. 2, 2010.
Richard E. Lofftus, Jr. "System Charge and Performance Evaluation." HVAC/R Training, Vatterott College. Jan. 2007.
Search Report regarding Chinese Patent Application No. 201610244700.4, dated Mar. 25, 2018.
Search Report regarding European Patent Application No. 08251185.8-1605 / 2040016, dated Dec. 4, 2015.
Search Report regarding European Patent Application No. 10830696.0, dated Jul. 18, 2017.
Search Report regarding European Patent Application No. 12752872.7, dated May 4, 2017.
Search Report regarding European Patent Application No. 13736303.2-1806, dated Sep. 17, 2015.

(56) References Cited

OTHER PUBLICATIONS

Search Report regarding European Patent Application No. 13841699.5, dated Jun. 30, 2016.
Search Report regarding European Patent Application No. 14763232.7, dated Oct. 27, 2016.
Search Report regarding European Patent Application No. 14764311.8, dated Oct. 27, 2016.
Search Report regarding European Patent Application No. 14780284.7, dated Nov. 2, 2016.
Search Report regarding European Patent Application No. 16187893.9, dated Jan. 19, 2017.
Second Examination Communication regarding European Application No. EP02729051.9, dated Jul. 3, 2006.
Second Office Action from the State Intellectual Property Office of People's Republic of China regarding Chinese Patent Application No. 201110349785.X, dated Jul. 25, 2014. Translation provided by Unitalen Attorneys at Law.
Second Office Action issued by the Chinese Patent Office for Application No. 200480015875.3, dated Feb. 27, 2009.
Second Office Action issued by the Chinese Patent Office on Mar. 6, 2009 regarding Application No. 200580013451.8, 7 Pages. Translation provided by CCPIT Patent and Trademark Law Office.
Second Office Action received from the Chinese Patent Office dated Jun. 26, 2009 regarding Application No. 200480011463.2, translated by CCPIT Patent and Trademark Law Office.
Second Office Action regarding Chinese Patent Application No. 200780030810.X, dated Aug. 4, 2010. English translation provided by Unitalen Attorneys at Law.
Second Office Action regarding Chinese Patent Application No. 200890100287.3, dated Jan. 27, 2011. English translation provided by Unitalen Attorneys at Law.
Second Office Action regarding Chinese Patent Application No. 200910211779.0, dated Feb. 4, 2013. English translation provided by Unitalen Attorneys at Law.
Second Official Report regarding Australian Patent Application No. 2007214381, dated Oct. 30, 2009.
Supplementary European Search Report for EP 02731544, dated Jun. 18, 2004, 2 Pages.
Supplementary European Search Report regarding Application No. PCT/US2006/005917, dated Nov. 23, 2009.
Supplementary European Search Report regarding European Application No. EP06790063, dated Jun. 15, 2010.
Tamarkin, Tom D., "Automatic Meter Reading," Public Power magazine, vol. 50, No. 5, Sep.-Oct. 1992, http://www.energycite.com/news/amr.html, 6 pages.
Texas Instruments, Inc. Mechanical Data for "PT (S-PQFP-G48) Plastic Quad Flatpack," Revised Dec. 1996, 2 pages.
Texas Instruments, Inc., Product catalog for "TRF690 1 Single-Chip RF Transceiver," Copyright 2001-2003, Revised Oct. 2003, 27 pages.
The Honeywell HVAC Service Assistant, A Tool for Reducing Electrical Power Demand and Energy Consumption, Field Diagnostics, 2003.
The LS2000 Energy Management System, User Guide, http://www.surfnetworks.com/htmlmanuals/IonWorksEnergyManagement-LS2000-Load-Shed-System-by-Surf-Networks,Inc.html, Sep. 2004, 20 pages.
Third Chinese Office Action regarding Application No. 201110349785.X, dated Jan. 30, 2015. Translation provided by Unitalen Attorneys at Law.
Third Office Action regarding Chinese Application No. 2005100059078 from the State Intellectual Property Office of People's Republic of China, dated Aug. 24, 2011. Translation provided by Unitalen Attorneys at Law.
Torcellini, P., et al., "Evaluation of the Energy Performance and Design Process of the Thermal Test Facility at the National Renewable Energy Laboratory", dated Feb. 2005.
Trane EarthWise™ CenTra Vac™ Water-Cooled Liquid Chillers 165-3950 Tons 50 and 60 Hz; CTV PRC007-EN; Oct. 2002; 56 pages.
Translation of claims and Abstract of KR Patent Laying-Open No. 2000-0000261.
U.S. Office Action regarding U.S. Appl. No. 13/269,188, dated May 8, 2015.
U.S. Office Action regarding U.S. Appl. No. 14/212,632, dated May 15, 2015.
Udelhoven, Darrell, "Air Conditioner EER, SEER Ratings, BTUH Capacity Ratings, & Evaporator Heat Load," http://www.udarrell.com/air-conditioner-capacity-seer.html, Apr. 3, 2003, 15 pages.
Udelhoven, Darrell, "Air Conditioning System Sizing for Optimal Efficiency," http://www.udarrell.com/ airconditioning-sizing.html, Oct. 6, 2003, 7 pages.
Udelhoven, Darrell, "Optimizing Air Conditioning Efficiency TuneUp Optimizing the Condenser Output, Seer, Air, HVAC Industry," http://www.udarrell.com/air-conditioning-efficiency.html, Jul. 19, 2002, 13 pages.
Ultrasite 32 User's Guide, Computer Process Controls, Sep. 28, 1999.
Ultrasite User's Guide BCU Supplement, Computer Process Controls, Sep. 4, 1997.
Ultrasite User's Guide BEC Supplement, Computer Process Controls, Oct. 6, 1997.
Ultrasite User's Guide RMCC Supplement, Computer Process Controls, Jun. 9, 1997.
UltraSite User's Guide, Computer Process Controls, Apr. 1, 1996.
Vandenbrink et al.,"Design of a Refrigeration Cycle Evaporator Unit," Apr. 18, 2003.
Watt, James; Development of Empirical Temperature and Humidity-Based Degraded-Condition Indicators for Low-Tonnage Air Conditioners; ESL-TH-97/12-03; Dec. 1997.
Written Opinion from related PCT Application No. PCT/US2014/028074, dated Jun. 19, 2014.
Written Opinion of International Searching Authority for International Application No. PCT/US2008/009618, dated Dec. 8, 2008.
Written Opinion of the International Searching Authority for International Application No. PCT/US2008/012364, dated Mar. 13, 2009.
Written Opinion of the International Searching Authority regarding Application No. PCT/US2007/016135, dated Oct. 22, 2007.
Written Opinion of the International Searching Authority regarding Application No. PCT/US2010/036601, dated Dec. 29, 2010.
Written Opinion of the International Searching Authority regarding Application No. PCT/US2012/026973, dated Sep. 3, 2012.
Written Opinion of the International Searching Authority regarding Application No. PCT/US2013/021161, dated May 8, 2013.
Written Opinion of the International Searching Authority regarding Application No. PCT/US2013/061389, dated Jan. 22, 2014.
Written Opinion of the International Searching Authority regarding International Application No. PCT/US2007/019563, dated Jan. 15, 2008.
Written Opinion of the International Searching Authority, International App. No. PCT/US06/05917, dated Sep. 26, 2007.
Written Opinion regarding PCT/US02/13459, dated Apr. 23, 2003.
U.S. Appl. No. 14/208,636, filed Mar. 13, 2014, Hung M. Pham.
U.S. Appl. No. 14/949,090, filed Nov. 23, 2015, Nagaraj Jayanth et al.
U.S. Appl. No. 15/096,186, filed Apr. 11, 2016, Lawrence Kates.
U.S. Appl. No. 15/613,375, filed Jun. 5, 2017, Hung M. Pham.
U.S. Appl. No. 15/633,657, filed Jun. 26, 2017, Lawrence Kates.
U.S. Appl. No. 15/798,081, filed Oct. 30, 2017, Hung M. Pham.
U.S. Appl. No. 16/357,235, filed Mar. 18, 2019, Jeffrey N. Arensmeier.
Notice of Allowance regarding U.S. Appl. No. 14/949,090, dated Nov. 26, 2018.
First Examination Report regarding Indian Patent Application No. 479/MUMNP/2015, dated Dec. 21, 2018.
Office Action regarding U.S. Appl. No. 14/949,090, dated Feb. 14, 2019.
Office Action regarding U.S. Appl. No. 15/633,657, dated Feb. 20, 2019.
Notice of Allowance regarding U.S. Appl. No. 15/096,186, dated Feb. 26, 2019.
Notice of Allowance regarding U.S. Appl. No. 15/613,375, dated Feb. 27, 2019.

(56) References Cited

OTHER PUBLICATIONS

First Examination Report regarding Indian Patent Application No. 2574/MUMNP/2015, dated Mar. 20, 2019.

* cited by examiner

METHOD OF MONITORING CHARGE CONDITION OF HEAT PUMP SYSTEM

CROSS-REFERENCE TO RELATED APPLICATIONS

This application is a divisional of U.S. patent application Ser. No. 14/607,782 filed on Jan. 28, 2015, which is a continuation of U.S. patent application Ser. No. 14/244,967 (now U.S. Pat. No. 9,765,979) filed on Apr. 4, 2014, which claims the benefit of U.S. Provisional Application No. 61/808,688 filed on Apr. 5, 2013. The entire disclosures of the above applications are incorporated herein by reference.

FIELD

The present disclosure relates to a heat-pump system having refrigerant charge diagnostics.

BACKGROUND

This section provides background information related to the present disclosure and is not necessarily prior art.

A climate-control system such as, for example, a heat-pump system, a refrigeration system, or an air conditioning system, may include a fluid circuit having an outdoor heat exchanger, an indoor heat exchanger, an expansion device disposed between the indoor and outdoor heat exchangers, and a compressor circulating a working fluid (e.g., refrigerant or carbon dioxide) between the indoor and outdoor heat exchangers. Maintaining proper amounts of working fluid in the system (i.e., refrigerant charge levels) is desirable for effective and efficient operation of the climate-control system.

SUMMARY

This section provides a general summary of the disclosure, and is not a comprehensive disclosure of its full scope or all of its features.

In one form, the present disclosure provides a method that may include determining a working-fluid-charge condition of a heat-pump system based on at least one of a supply-air temperature and a return-air temperature. In some embodiments, the working-fluid charge condition may be determined by a cloud-based processing device.

In another form, a monitor may be provided for a heat-pump circuit. The heat-pump circuit may include an indoor heat exchanger, an outdoor heat exchanger, a compressor circulating a working fluid between the indoor and outdoor heat exchangers, and an expansion device between the indoor and outdoor heat exchangers. The monitor may include a return-air temperature sensor, a supply-air temperature sensor, and a processor. The return-air temperature sensor may be adapted to measure a first air temperature of air upstream of the indoor heat exchanger. The supply-air temperature sensor may be adapted to measure a second air temperature of air downstream of the indoor heat exchanger. The processor may be in communication with the return-air temperature sensor and the supply-air temperature sensor. The processor may be programmed to determine a working-fluid-charge condition of the heat-pump system based on the first and second air temperatures.

In some embodiments, the processor is programmed to determine the working-fluid-charge condition based on a difference between the second air temperature and the first air temperature and a comparison of the difference with a predetermined value.

In some embodiments, the monitor includes a working-fluid temperature sensor disposed between the expansion device and the indoor heat exchanger and adapted to measure a working-fluid temperature of working fluid flowing between the indoor heat exchanger and the expansion device when the heat-pump system is operating in a heating mode. The processor may be in communication with the working-fluid temperature sensor and may be programmed to determine the working-fluid-charge condition of the heat-pump system based on the working-fluid temperature.

In some embodiments, the processor is programmed to determine the working-fluid-charge condition based a first difference between the second air temperature and the working-fluid temperature.

In some embodiments, the processor is programmed to determine the working-fluid-charge condition based on a second difference between the second air temperature and the first air temperature.

In some embodiments, the processor is programmed to determine the working-fluid charge condition based only on a first comparison of the first difference with a first predetermined value and a second comparison of the second difference with a second predetermined value.

In some embodiments, the processor is programmed to determine the working-fluid-charge condition based a third difference between the working-fluid temperature and the second air temperature.

In some embodiments, the processor is programmed to determine the working-fluid charge condition based on a first comparison of the first difference with a first predetermined value, a second comparison of the second difference with a second predetermined value, and a third comparison of the third difference with a third predetermined value.

In some embodiments, the processor is in communication with a notification device configured to generate a first alert indicating that a fault condition of the heat-pump system is related to the working-fluid-charge condition and a second alert indicating that the fault condition of the heat-pump system is unrelated to an amount of working fluid in the heat-pump system.

In some embodiments, the processor is a cloud-based processor. The notification device may include a mobile, wireless computing device, for example.

In some embodiments, the processor is in communication with a notification device configured to generate an alert indicating the working-fluid-charge condition.

In some embodiments, the processor is a cloud-based processor disposed remotely from the compressor, the return-air temperature sensor and the supply-air temperature sensor.

In another form, the present disclosure provides a method of monitoring a heat-pump system. The heat-pump system may include indoor and outdoor heat exchangers, a compressor adapted to circulate a working fluid between the indoor and outdoor heat exchangers, and an expansion device disposed between the indoor and outdoor heat exchangers. The method may include receiving a first air temperature value of air upstream of the indoor heat exchanger from a return-air temperature sensor; receiving a second air temperature of air downstream of the indoor heat exchanger from a supply-air temperature sensor; and determining a working-fluid-charge condition of the heat-pump system using a processor programmed to determine the working-fluid-charge condition based on the first and second air temperatures.

In some embodiments, the working-fluid-charge condition is determined based on the first and second air temperatures and a working-fluid temperature measured by a working-fluid temperature sensor disposed downstream the indoor heat exchanger when the heat-pump system is in a heating mode.

In some embodiments, the first and second air temperature values are acquired while the heat-pump system is operating in a heating mode.

In some embodiments, the working-fluid temperature sensor is disposed between the indoor heat exchanger and the expansion device.

In some embodiments, the processor is programmed to determine the working-fluid-charge condition based on a difference between the second air temperature and the first air temperature and a comparison of the difference with a predetermined value.

In some embodiments, the method may include receiving a working-fluid temperature of working-fluid flowing between the indoor and outdoor heat exchangers. The processor may be programmed to determine the working-fluid-charge condition of the heat-pump system based on the working-fluid temperature.

In some embodiments, the method includes receiving a working-fluid temperature of working-fluid flowing between the indoor heat exchanger and the expansion device when the heat-pump system is operating in a heating mode. The processor may be programmed to determine the working-fluid-charge condition of the heat-pump system based on the working-fluid temperature.

In some embodiments, the processor is programmed to determine the working-fluid-charge condition based a first difference between the second air temperature and the working-fluid temperature.

In some embodiments, the processor may be programmed to determine the working-fluid-charge condition based on a second difference between the second air temperature and the first air temperature.

In some embodiments, the processor is programmed to determine the working-fluid charge condition based only on a first comparison of the first difference with a first predetermined value and a second comparison of the second difference with a second predetermined value.

In some embodiments, the processor is programmed to determine the working-fluid-charge condition based a third difference between the working-fluid temperature and the second air temperature.

In some embodiments, the processor is programmed to determine the working-fluid charge condition based on a first comparison of the first difference with a first predetermined value, a second comparison of the second difference with a second predetermined value, and a third comparison of the third difference with a third predetermined value.

In some embodiments, the method includes generating a first alert with a notification device indicating that a fault condition of the heat-pump system is related to the working-fluid-charge condition; and generating a second alert with the notification device indicating that the fault condition of the heat-pump system is unrelated to an amount of working fluid in the heat-pump system.

In another form, the present disclosure provides a working-fluid circuit having a processor in communication with a return-air temperature sensor and a supply-air temperature sensor, a compressor circulating a working fluid between the indoor and outdoor heat exchangers, and an expansion device between the indoor and outdoor heat exchangers. The processor may be programmed to determine a working-fluid-charge condition of the working-fluid circuit based on a first air temperature of air upstream of the indoor heat exchanger from the return-air temperature sensor and a second air temperature of air downstream of the indoor heat exchanger from the supply-air temperature sensor.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
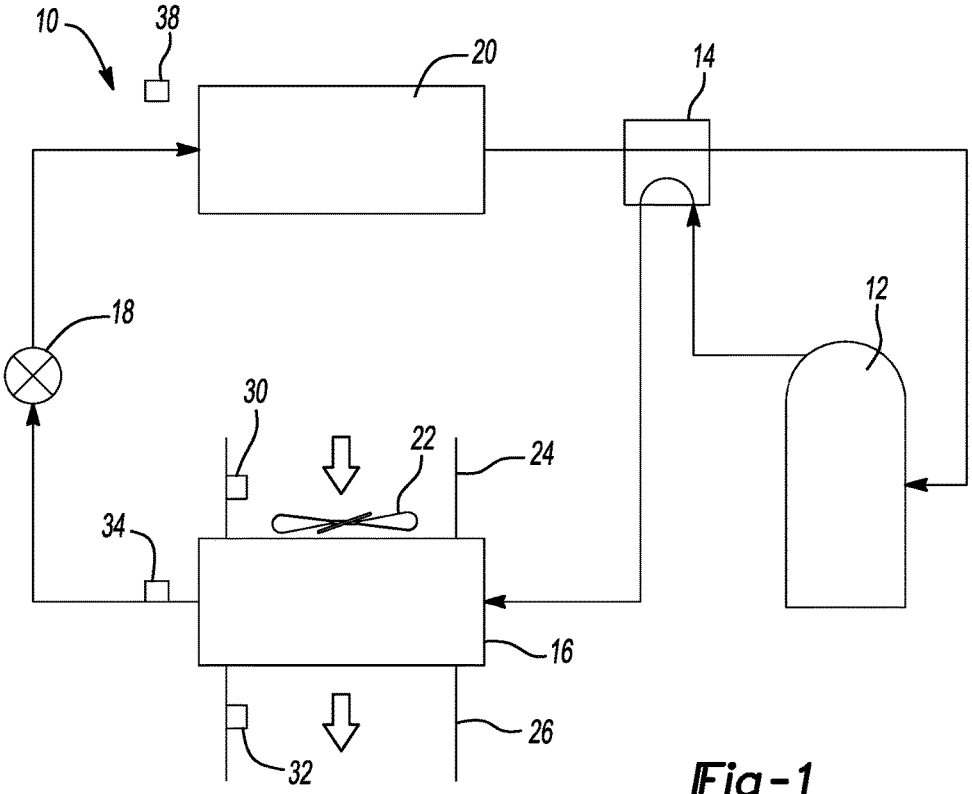
FIG. 1 is a schematic representation of a heat-pump system according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIG. 1, a heat-pump system 10 is provided that may include a compressor 12, a reversing valve 14, an indoor heat exchanger 16, an expansion device 18, and an outdoor heat exchanger 20. The compressor 12 can be a scroll compressor, a reciprocating compressor, or a rotary vane compressor, for example, or any other type of compressor. The reversing valve 14 may be a four-way valve operable to control a direction of working fluid flow through the heat-pump system 10. A controller (not shown) may switch the reversing valve 14 between a first position (not shown) corresponding to a cooling mode and a second position corresponding to a heating mode (shown in FIG. 1).

In the cooling mode, the outdoor heat exchanger 20 may operate as a condenser or as a gas cooler and may cool discharge-pressure working fluid received from the compressor 12 by transferring heat from the working fluid to ambient air, for example. In the heating mode, the outdoor heat exchanger 20 may operate as an evaporator.

In the cooling mode, the indoor heat exchanger 16 may operate as an evaporator and may transfer heat from a space to be cooled (e.g., a room within a house or building) to the working fluid in the indoor heat exchanger 16. In the heating mode, the indoor heat exchanger 16 may operate as a condenser or as a gas cooler and may transfer heat from working fluid discharged from the compressor 12 to a space to be heated. During operation of the heat-pump system 10, a fan 22 may draw air from the space to be heated or cooled through a return-air duct 24 and force the air across the indoor heat exchanger 16 to transfer heat between the working fluid in the indoor heat exchanger 16 and the air. From the indoor heat exchanger 16, the heated or cooled air may be forced through a supply-air duct 26 to the space to be heated or cooled.

The heat-pump system 10 may also include a return-air temperature sensor 30, a supply-air temperature sensor 32, a liquid-line temperature sensor 34, and an outside-air temperature sensor 38. The return-air temperature sensor 30 may be disposed in the return-air duct 24 and may measure a temperature of the air flowing therethrough. The supply-air temperature sensor 32 may be disposed in the supply-air duct 26 and may measure a temperature of the air flowing therethrough. The liquid-line temperature sensor 34 may be disposed between the indoor heat exchanger 16 and the expansion device 18 and may measure a temperature of the working fluid flowing therebetween. The outside-air temperature sensor 38 may be disposed in any suitable location to measure a temperature of ambient air outside of the house or building.

Figure 2:
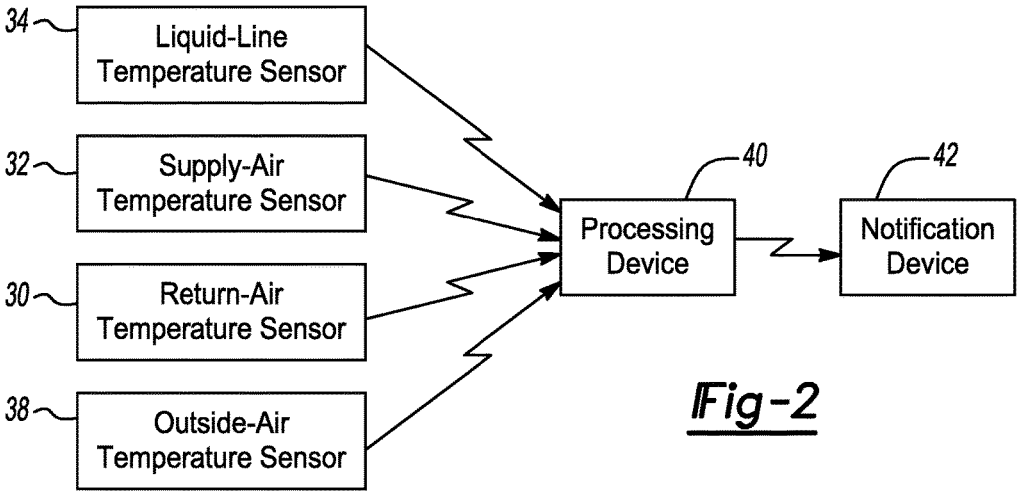
FIG. 2 is a schematic representation of a plurality of sensors associated with the heat-pump system communicating with a remote processing device.

As shown in FIG. 2, the sensors 30, 32, 34, 38 may be in communication with a remotely located or on-site processing device 40. In some embodiments, any or all of the sensors 30, 32, 34, 38 may be installed in the locations described above. In some embodiments, any or all of the sensors 30, 32, 34, 38 may be handheld sensors that a technician may temporarily place in the locations described above, obtain temperature measurements in those locations, and transmit the data to the processing device 40. Any or all of the sensors 30, 32, 34, 38 may be incorporated into a newly installed heat-pump system, or any or all of the sensors 30, 32, 34, 38 may be retrofitted to a pre-existing heat-pump system that has already been installed within a house or building. In some configurations, the outside-air temperature sensor 38 could be a thermometer or other sensor of a weather monitoring and/or weather reporting system or entity. In such configurations, the processor 40 may obtain the outside-air temperature measured by the sensor 38 from the weather monitoring and/or weather reporting system or entity via an internet, Bluetooth® or cellular connection, for example.

The processing device 40 may include a cloud-computing module having hardware (e.g., a processor and/or memory) and software capable of carrying the functionality described below. The processing device 40 may be in communication with a server that may receive data from the sensors 30, 32, 34, 38 via an internet connection or cellular network, for example. The processing device 40 may receive data from the sensors 30, 32, 34, 38 on demand, intermittently or in real time. In some embodiments, the processing device 40 may be located on a contractor or technician's portable computing device (e.g., a laptop, tablet, smartphone or other device), or may be located within the house or building in which the heat-pump system 10 is installed (e.g., in a thermostat (not shown) or a control module (not shown) for the heat-pump system 10).

The processing device 40 may also be in communication with one or more notification devices 42 that may be disposed remotely from the processing device 40 and/or the sensors 30, 32, 34, 38. The notification devices 42 may include any of a desktop computer, a laptop computer, a hand-held computing device, a tablet, or a smartphone, for example, or any other computing device or electronic information display device. In some embodiments, the one or more notification devices 42 may be a part of a wall-mounted thermostat unit.

As will be subsequently described, the processing device 40 may, based on data received from one or more of the sensors 30, 32, 34, 38, diagnose faults conditions (e.g., undercharge conditions, overcharge conditions and/or flow restriction conditions) of the heat-pump system 10, verify a charge level of the heat-pump system 10, and/or provide guidance to a technician during initial installation of the heat-pump system 10 for adding an appropriate amount of working fluid into the heat-pump system 10. Notifications, alerts, updates and/or other information output from the processing device 40 may be transmitted to one or more notification devices 42 and may be accessed or displayed thereon. In some embodiments, the notifications, alerts, updates and/or other information output from the processing device 40 may be transmitted to the notification device 42 via email, text message, instant message, multimedia message. In some embodiments, the notification device 42 may include a mobile application (e.g., a smartphone or tablet application) that provides notifications, alerts, updates, and/or other information based on output from the processing device 40.

Figure 3:
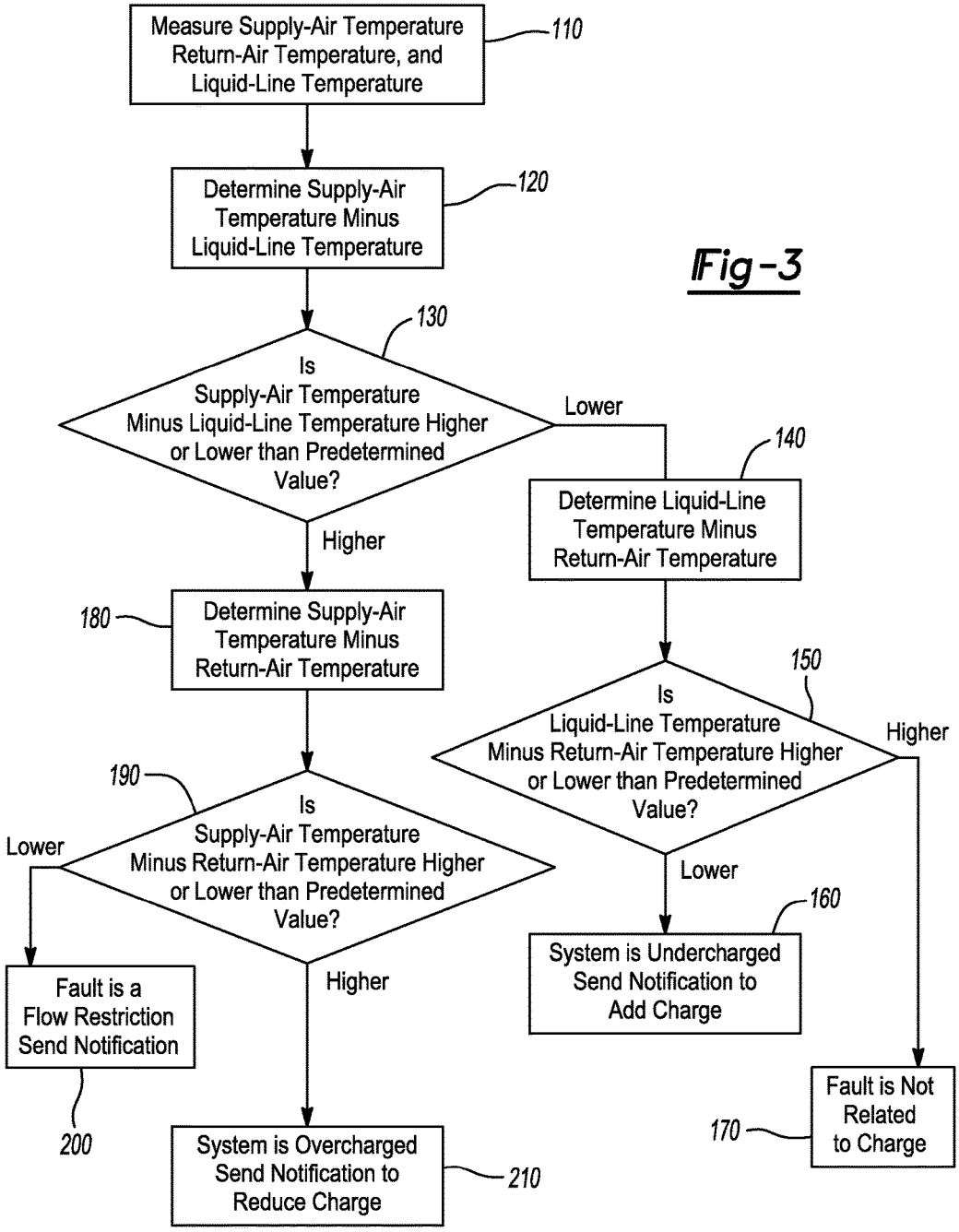
FIG. 3 is a flow chart illustrating a method of determining a charge level according to the principles of the present disclosure.

With reference to FIGS. 1-3, a method of diagnosing a fault condition when the heat-pump system 10 is in a heating mode will be described in detail. The method may include determining whether a reason for inefficient and/or ineffective operation of the heat-pump system 10 is an undercharge condition (i.e., not enough working fluid in the heat-pump system 10), an overcharge condition (i.e., too much working fluid in the heat-pump system 10), or a flow restriction in the heat-pump system 10 (e.g., a working-fluid-flow restriction in the liquid line or an airflow restriction at the outdoor heat exchanger 20 or at the indoor heat exchanger 16).

At step 110, the return-air temperature sensor 30, supply-air temperature sensor 32, and the liquid-line temperature sensor 34 may detect temperatures at their respective locations and transmit this data to the processing device 40. As described above, detecting and transmitting this data may be done on-demand, intermittently, averaged over a time period, or in real time. At step 120, the processing device 40 may determine a value equal to supply-air temperature minus a liquid-line temperature. When the heat-pump system 10 is operating in the heating mode, the liquid-line temperature may be a temperature detected by the liquid-line temperature sensor 34.

At step 130, the processing device 40 may determine if the value calculated at step 120 (supply-air temperature minus liquid-line temperature) is higher or lower than a first predetermined value. The first predetermined value may correspond to a particular heat pump system and/or may be based on a current outside-air temperature determined by the outside-air temperature sensor 38.

If the processing device 40 determines (at step 130) that the value determined at step 120 is lower than the first predetermined value, the processing device 40 may calculate, at step 140, a value equal to liquid-line temperature minus a return-air temperature. At step 150, the processing device 40 may determine if the value calculated at step 140 (liquid-line temperature minus return-air temperature) is higher or lower than a second predetermined value. The second predetermined value may correspond to a particular heat-pump system and/or may be based on a current outside-air temperature determined by the outside-air temperature sensor 38. If, at step 150, the processing device 40 determines that the value calculated at step 140 is lower than the second predetermined value, then the processing device 40 may, at step 160, send a notification to the notification device 42 indicating that the heat-pump system 10 is undercharged and working fluid should be added to the heat-pump system 10. If, at step 150, the processing device 40 determines that the value calculated at step 140 is higher than the second predetermined value, then the processing device 40 may, at step 170, determine that the system charge is adequate and/or any system fault may not be related to system charge.

If, at step 130, the processing device 40 determines that the value determined at step 120 is higher than the first predetermined value, the processing device 40 may calculate, at step 180, a value equal to supply-air temperature minus return-air temperature. At step 190, the processing device 40 may determine if the value calculated at step 180 (supply-air temperature minus return-air temperature) is higher or lower than a third predetermined value. The third predetermined value may correspond to a particular heat-pump system and/or may be based on a current outside-air temperature determined by the outside-air temperature sensor 38. If, at step 190, the processing device 40 determines that the value calculated at step 180 is lower than the third predetermined value, then the processing device 40 may, at step 200, send a notification to the notification device 42 indicating that there is a working fluid flow restriction in the heat-pump system 10. If, at step 190, the processing device 40 determines that the value calculated at step 180 is higher than the third predetermined value, then the processing device 40 may, at step 210, send a notification to the notification device 42 indicating that the heat-pump system 10 is overcharged and an amount of working fluid in the heat-pump system 10 should be reduced.

In addition to diagnosing a fault of the heat-pump system 10, the processing device 40 may perform the above method steps to verify a charge of the heat-pump system 10 on-demand or at predetermined time intervals, for example. If the processing device 40 determines that the heat-pump system 10 is overcharged, undercharged and/or some other fault condition exists, the processing device 40 may send an appropriate notification to the notification device 42, as described above.

The processing device 40 and notification device 42 may also be used by a technician to perform an initial charge of the heat-pump system 10 during the initial installation of the heat-pump system 10 into the house or building. That is, real time supply-air, return-air, liquid-line and outside-air temperature measurements can be processed by the processing device 40 and real-time feedback from the processing device 40 can be provided to the technician via the notification device 42 that indicates when the heat-pump system 10 has reached an optimum charge level (i.e., when the technician should stop adding working fluid to the heat-pump system 10).

For example, the processing device 40 may monitor (in real time) a value of liquid-line temperature minus return-air temperature. This value may continue to increase as the technician adds working fluid during the initial system charge until an optimum charge level is achieved. Once the optimum charge level is achieved, adding more working fluid to the heat-pump system 10 may cause the value of liquid-line temperature minus return-air temperature to decrease. Therefore, the processing device 40 and notification device 42 may notify the technician as soon as the value of liquid-line temperature minus return-air temperature starts to decrease. When the technician receives this notification, he or she may stop adding working fluid to the heat-pump system 10.

The first, second and third predetermined values described above may be chosen to correspond to a particular heat-pump system and may be determined through experimentation or from look-up tables, for example.

In this application, including the definitions below, the term module may be replaced with the term circuit. The term module may refer to, be part of, or include an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor (shared, dedicated, or group) that executes code; memory (shared, dedicated, or group) that stores code executed by a processor; other suitable hardware components that provide the described functionality; or a combination of some or all of the above, such as in a system-on-chip.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. As used herein, the phrase at least one of A, B, and C should be construed to mean a logical (A or B or C), using a non-exclusive logical OR. It should be understood that one or more steps within a method may be executed in different order (or concurrently) without altering the principles of the present disclosure.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A method of monitoring a heat-pump system having indoor and outdoor heat exchangers, a compressor adapted to circulate a working fluid between the indoor and outdoor heat exchangers, and an expansion device disposed between the indoor and outdoor heat exchangers, the method comprising:

receiving a first air temperature value of air upstream of the indoor heat exchanger from a return-air temperature sensor when the heat-pump system is operating in the heating mode;

receiving a second air temperature value of air downstream of the indoor heat exchanger from a supply-air temperature sensor when the heat-pump system is operating in the heating mode;

receiving, from a working-fluid temperature sensor, a working-fluid temperature value of working fluid flowing between the expansion device and the indoor heat exchanger when the heat-pump system is operating in the heating mode;

determining, using a processor, a first difference between the second air temperature and the working-fluid temperature and a second difference between the second air temperature and the first air temperature; and determining, using the processor, a working-fluid-charge condition of the heat-pump system based on a first comparison of the first difference with a first predetermined value and a second comparison of the second difference with a second predetermined value.

2. The method of claim 1, further comprising determining, using the processor, a third difference between the working-fluid temperature and the second air temperature.

3. The method of claim 2, wherein determining the working-fluid charge condition is further based on a third comparison of the third difference with a third predetermined value.

4. The method of claim 3, further comprising generating a first alert with a notification device indicating that a fault condition of the heat-pump system is related to the working-fluid-charge condition.

5. The method of claim 4, further comprising generating a second alert with the notification device indicating that the fault condition of the heat-pump system is unrelated to an amount of working fluid in the heat-pump system.

6. The monitor of claim 5, further comprising generating a third alert indicating that the fault condition of the heat-pump system is related to a working fluid undercharge condition if the third difference is lower than the third predetermined value.

7. The monitor of claim 6, further comprising generating a fourth alert indicating that the fault condition of the heat-pump system is unrelated to an amount of working fluid in the heat-pump system if the third difference is higher than the third predetermined value.

* * * * *